US010689881B2

(12) United States Patent
Wolfish et al.

(10) Patent No.: US 10,689,881 B2
(45) Date of Patent: Jun. 23, 2020

(54) KIT ADAPTED TO ALLOW AFFIXING ACCESSORIES DESIGNED TO OPERATE WITH EUROPEAN LOCKING CYLINDERS, TO OPERATE AN AMERICAN TYPE MORTISE LOCK

(71) Applicants: SAFTEK LTD., Tel Aviv (IL); HAIM MINTZ GELEMLOCK LTD, Petach Tikva (IL)

(72) Inventors: Arnon Wolfish, Tel Aviv (IL); Yair Mintz, Petach Tikva (IL)

(73) Assignees: SAFTEK LTD., Tel Aviv (IL); HAIM MINTZ GELEMLOCK LTD, Petach Tikva (IL)

( * ) Notice: Subject to any disclaimer, the term of this patent is extended or adjusted under 35 U.S.C. 154(b) by 0 days.

(21) Appl. No.: 16/076,298

(22) PCT Filed: Feb. 5, 2017

(86) PCT No.: PCT/IL2017/050139
§ 371 (c)(1),
(2) Date: Aug. 7, 2018

(87) PCT Pub. No.: WO2017/050139
PCT Pub. Date: Feb. 5, 2017

(65) Prior Publication Data

US 2019/0145126 A1 May 16, 2019

(30) Foreign Application Priority Data

Feb. 7, 2016 (IL) ..... 244004

(51) Int. Cl.
*E05B 9/04* (2006.01)
*E05B 17/04* (2006.01)
(Continued)

(52) U.S. Cl.
CPC ..... *E05B 9/042* (2013.01); *E05B 9/04* (2013.01); *E05B 9/084* (2013.01); *E05B 17/04* (2013.01);
(Continued)

(58) Field of Classification Search
CPC ..... E05B 9/042; E05B 9/084; E05B 55/005; E05B 15/00; E05B 63/0056; E05B 17/04; E05B 9/04; E05B 9/086; E05B 9/10
(Continued)

(56) References Cited

U.S. PATENT DOCUMENTS 3,961,508 A * 6/1976 Crepinsek ..... E05B 9/084 70/370
4,876,783 A 10/1989 Campion et al.
(Continued)

FOREIGN PATENT DOCUMENTS

WO 2012035526 A1 3/2012
WO 2017134675 A1 8/2017

OTHER PUBLICATIONS

International Search Report; PCT Application No. PCT/IL2017/050139; dated May 23, 2017.
(Continued)

*Primary Examiner* — Lloyd A Gall
(74) *Attorney, Agent, or Firm* — Mark M. Friedman

(57) ABSTRACT

A cylinder-lock assembly configured to allow affixing accessories that are designed to be operatively coupled with a standard European locking cylinder to operate an American mortise type lock system. The cylinder-lock assembly includes a cylinder-lock-member that includes a cylinder-housing having an external shape of a European cylinder-housing, and a cylindrical lock core. The cylinder-housing defines a cylindrical through bore configured to receive the cylindrical shaft, and the cylindrical shaft is adapted to rotate
(Continued)

there inside the cylinder-housing. The cylinder-lock assembly further includes an adapting-ring, a cylindrical American housing and a rotation-conveyor, configured to operatively convey rotational motion of a fitted key, which is disposed inside the cylindrical shaft, to an American-lock type cam, to thereby actuate the door lock/unlock mechanism of the American type mortise lock.

17 Claims, 14 Drawing Sheets

(51) Int. Cl.
*E05B 55/00* (2006.01)
*E05B 9/08* (2006.01)
*E05B 63/00* (2006.01)
*E05B 15/00* (2006.01)

(52) U.S. Cl.
CPC ..... *E05B 55/005* (2013.01); *E05B 63/0056* (2013.01); *E05B 15/00* (2013.01)

(58) Field of Classification Search
USPC ..... 70/134, 466, 381, 379 R, 379 A, 380, 70/367–375, 447–452
See application file for complete search history.

(56) References Cited

U.S. PATENT DOCUMENTS 4,926,670 A 5/1990 Deforrest
5,233,851 A * 8/1993 Florian ..... E05B 9/084 70/367
5,884,512 A * 3/1999 Wayne ..... E05B 9/084 70/370
7,475,578 B2 * 1/2009 Brown ..... E05B 63/0034 292/336.3
7,716,958 B2 * 5/2010 Martin ..... E05B 9/04 70/367
9,169,668 B2 * 10/2015 George ..... E05B 63/0056
2010/0180651 A1 * 7/2010 Andersson ..... E05B 47/0615 70/449
2010/0300161 A1 * 12/2010 Lin ..... E05B 27/00 70/134
2011/0011139 A1 * 1/2011 Marcelle ..... E05B 29/004 70/372
2014/0075728 A1 * 3/2014 George ..... E05B 63/0056 29/401.1
2018/0313114 A1 * 11/2018 Huang ..... E05B 63/0056

OTHER PUBLICATIONS

Written Opinion of PCT Application No. PCT/IL2017/050139; dated May 23, 2017.

* cited by examiner

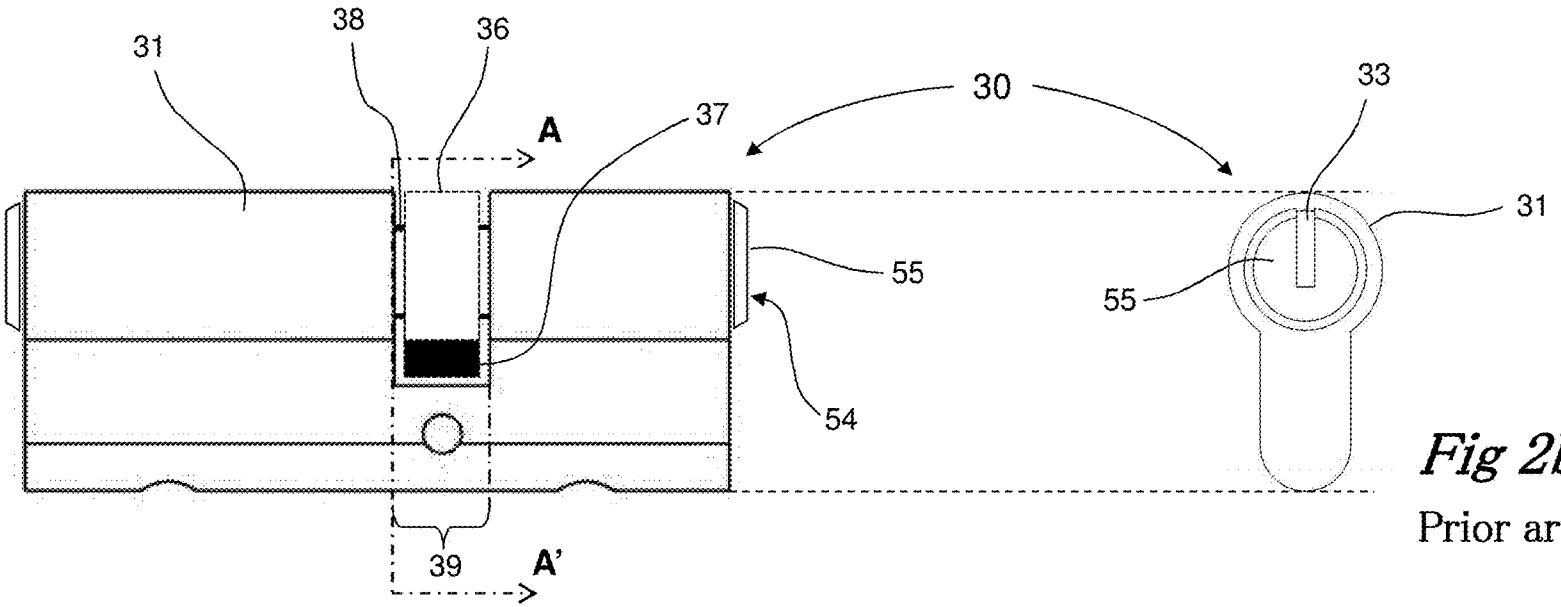
*Fig 2b*
Prior art
*Fig 2a*
Prior art
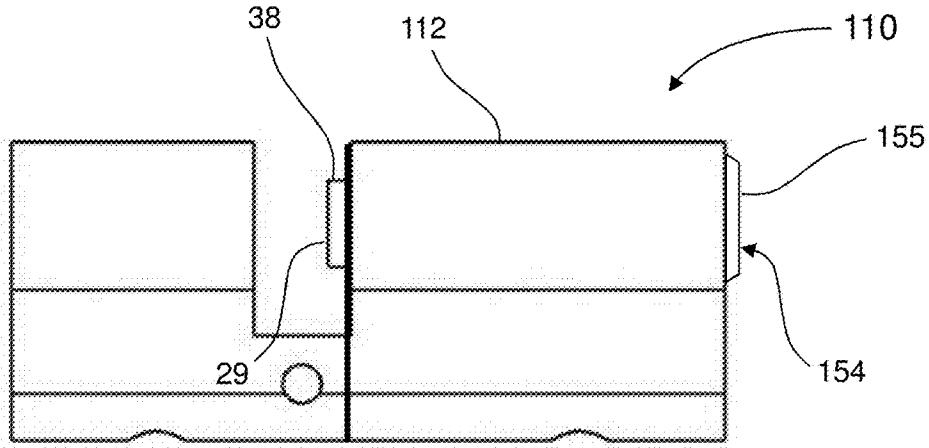
*Fig 3*

KIT ADAPTED TO ALLOW AFFIXING ACCESSORIES DESIGNED TO OPERATE WITH EUROPEAN LOCKING CYLINDERS, TO OPERATE AN AMERICAN TYPE MORTISE LOCK

CROSS-REFERENCE TO RELATED APPLICATIONS

This application is a national stage entry of PCT/IL2017/050139 filed Feb. 5, 2017, which claims convention priority from Israeli patent application 244004 filed on Feb. 7, 2016, the contents each of which are hereby incorporated by reference in their entirety.

FIELD OF THE INVENTION

This disclosure relates generally to door locking systems and, more particularly, to a cylinder-lock assembly that facilitates affixing accessories, designed to be operatively coupled with a standard European locking cylinder, to operate an American cylinder type mortise lock.

BACKGROUND OF THE INVENTION AND PRIOR ART

Windows and doors for homes and commercial establishments are protected predominantly by key-actuated locks. Two primary main locking cylinders are typically used in the market place. One such lock cylinder is referred to as the American type cylinder, and the other system is referred to as a European locking cylinder, a European cylinder lock and a European type cylinder. The European cylinder is also referred to as the Euro Profile cylinder.

The American locking cylinder is widely used as a standard cylinder lock in North America (United States), hotels locks and many more. The American cylinder lock is generally small in size and mounts from behind the door hardware in a wide range of door thicknesses. A flat tail piece extends from behind the mechanism of the American cylinder lock and extends into a mortise receiver, being part of an internal locking mechanism. The locking mechanism typically drives a bolt into a door's upright post, to thereby lock the door.

Referring to FIG. 1*a*, a typical knob/key American-cylinder operated lock assembly 20 is illustrated. FIG. 2*a* is a side view illustration of a standard European profile cylinder lock 30. Typically, cylinder mortise lock assembly 20 or 20' is mounted into a door 18 and includes a latch 22, a dead bolt 24 and a cylinder lock 30 having a cylindrical lock core 54. Cylinder lock core 54 is operable from a key engagement mechanism 55 by a key 40 and from the second hand side 29 by a key 40 or a knob 35. European cylinder lock 30 includes a cam-shaft 36 rotatably disposed in a preconfigured gap 39 in a housing 31 of cylinder lock core 54, mounted inside a cylindrical shaft 38. When key 40 is turned, cylindrical shaft 38 turns with it, to thereby turn cam-shaft 36 and cam 37 protruding outwardly therefrom. A key-receiving-slit 33 (see FIGS. 3, 6, 7 and 10) is formed in cylindrical shaft 38, which key-receiving-slit 33 is configured to receive a fitted key 40, having a specific fitting code, and a key verification mechanism (not shown) for verifying the key fitting code, wherein cylindrical shaft 38 and the key verification mechanism combine to form the cylindrical lock core 54.

FIG. 2*b* is a front view illustration of a standard European profile cylinder lock 30, wherein the unique external shape of the housing 31 of European cylinder-housing lock 30 is illustrated. The unique external shape of the housing 31 of European cylinder-housing lock 30 dictates shape and/or physical interface limitations to all affixing accessories that are designed to be operatively coupled with a standard European profile cylinder lock 30.

U.S. Pat. No. 9,169,668, given to Timothy Vincent George, discloses a kit and method for operating or operably connecting an American locking cylinder into a European cylinder type mortise lock with the American locking cylinder functioning with the European cylinder type mortise lock in place of the European locking cylinder itself. The present disclosure provides a door cylinder conversion kit that converts the European cylinder type mortise lock to be operable with an American locking cylinder.

U.S. Pat. No. 4,876,783, given to Campion et al., discloses a method of converting a conventional lock set from one manufacturer's lock cylinder to another's. The method includes provision of a universal doorknob or handle mountable, generally by means of adaptors, on any of a variety of manufactures of hardware systems. The universal knob includes means therein for mounting of a selected manufacture or design of lock cylinder. According to the method a tail piece member is provided, to translate motion from the lock cylinder to a drive mechanism of the hardware system being converted. Generally, according to the method each different design of lock cylinder will have a different universal knob design associated therewith. Further, each selected lock cylinder design will have associated therewith a set of tail piece members, one for each manufacture or design of hardware systems. As a result of the above, almost any type of hardware system can be readily converted to a system utilizing a universal knob and a selected lock cylinder.

International patent application WO/2012/035526, by Arnon WOLFISH, discloses a cylinder lock including an electronic system for indicating whether the lock is locked or unlocked. The cylinder lock includes a locking mechanism, a non-rotating body, an operationally cylinder, one or more markers, each securely disposed on the external surface of the cylinder. The electronic system further includes two or more sensors disposed inside the body of the cylinder lock, proximal to the external surface of the cylinder, wherein the markers are radially aligned with the respective sensors. The electronic system further includes a processor and indication means, operationally connected to the sensors and to the processor. When the cylinder is rotated in a locking direction, one of the markers faces a respective sensor, at least instantaneously, whereby the processor identifies that the lock is being locked. When the cylinder is rotated in an unlocking direction, another marker faces a respective sensor, at least instantaneously, whereby the processor identifies that the lock is being unlocked.

A standard European locking cylinder is designed to operate a European type mortise lock system. There is a wide variety of affixing accessories, such as a door lock rosette, that are designed to be operatively coupled with a standard European locking cylinder. As such, these affixing accessories are designed to fit onto the external profile of a standard European locking cylinder (see FIG. 2*b*).

It is often desired to use these affixing accessories that are designed to be operatively coupled with a standard European locking cylinder, to operate with an American type mortise lock. It is the intention of the present invention to facilitate such usage of these affixing accessories to operate with an American type mortise lock.

The subject matter discussed in this background of the invention section should not be assumed to be prior art merely as a result of it being mentioned in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions.

SUMMARY OF THE INVENTION

Normally, standard European locking cylinders are designed to operate European mortise type lock systems. It is the intention of the present invention to provide an interface that facilitates affixing accessories, such as a door lock rosette, that are designed to be operatively coupled with a standard European locking cylinder, to operate an American mortise type lock system. This allows the use of one master key for both types of mortise lock systems, American and European, in the same locking system.

The term "radially aligned", as used herein, refers to two elements being in radial alignment, wherein a first element is spatially affixed and the second element rotates about an axis such that in each revolution, the second element faces (being substantially in maximal proximity to) the first element. If the first element is a sensor, the first element can sense the instant when the second element faces the sensor, that is, when the second element is substantially most proximal to the sensor.

According to the teachings of the present invention, there is provided a cylinder lock assembly that is configured to allow affixing accessories that are designed to be operatively coupled with a European locking cylinder, to operate an American type mortise lock, wherein the American type mortise lock includes a door lock/unlock mechanism.

The cylinder-lock assembly includes a cylinder-lock-member that includes a cylinder-housing, having an external shape of a European cylinder-housing, and a cylindrical lock core, having a cylindrical shaft and a key verification mechanism, wherein the cylinder-housing defines a cylindrical through bore configured to receive the cylindrical shaft, and wherein the cylindrical shaft is adapted to rotate there inside the cylinder-housing. A key engagement end of the cylindrical lock core is adapted to receive a fitted key into a first key-receiving-slit formed in the cylindrical shaft, parallel to the rotational axis of the cylindrical shaft. A lateral slit is formed at the second circular end of the cylindrical shaft.

The cylinder-lock assembly further includes an adapting-ring, which adapting ring defines a first cylindrical through bore on a first side, and a second European-profile-shaped through bore on the second side. The first cylindrical through bore and the second European-profile shaped through bore are partially through bores, wherein the second European-profile shaped through bore is configured to receive the cylinder-housing.

The cylinder-lock assembly further includes a cylindrical American-lock-housing member having the dimensions of a standard American cylindrical lock housing, which cylindrical American-lock-housing member defines a through cylindrical bore, wherein the first cylindrical through bore of the adapting-ring is configured to receive the American housing.

The cylinder-lock assembly further includes a rotation-conveyor having a first end, defining a first rectangular protruding portion, and a second circular end defining a second rectangular protruding portion. The rotation-conveyor is configured to rotate within the through cylindrical bore of the American housing, wherein the first rectangular protruding portion of the rotation-conveyor is configured to be disposed inside the lateral slit of the cylindrical shaft to thereby operationally engage the rotation-conveyor with the cylindrical shaft.

The cylinder-lock assembly further includes an American-lock cam, with a cam arm and a body having a rectangular opening formed therein, the rectangular opening configured to receive the second rectangular protruding portion of the rotation-conveyor.

The American-lock cam defines fastener openings, typically, on each side of the rectangular opening. The cam arm is configured to operatively actuate the door lock/unlock mechanism of the American type mortise lock.

The cylinder-lock assembly further includes at least two fasteners configured to secure the American-lock cam to the second circular end of the rotation-conveyor that is disposed inside the through cylindrical bore of the American housing.

The cylinder-lock assembly is configured to operatively convey rotational motion of the fitted key, which is disposed inside the first key-receiving-slit of the cylindrical shaft, to the American-lock cam, to thereby actuate the door lock/unlock mechanism of the American type mortise lock.

In some embodiments, the adapting-ring and the American housing are configured as a single unit (a mortise-housing-adaptor), wherein the American-lock-housing member is fused into the first cylindrical through bore of the adapting-ring.

In some embodiments, the cylinder-lock-member and the rotation-conveyor are configured as a single unit, wherein the second circular end of the rotation-conveyor is fused into the second circular end of the cylindrical shaft and the lateral slit, forming a one-piece key-receiving-and-rotation-conveyor. Optionally, the one-piece key-receiving-and-rotation-conveyor includes a cylindrical shaft section and rotation-conveyor section, wherein a second key-receiving-slit, configured to receive a fitted key, is formed therein, parallel to the rotational axis of the key-receiving-and-rotation-conveyor, and wherein the second key-receiving-slit is extended into rotation-conveyor section.

In some embodiments, the non-through sections of the first cylindrical through bore forms at least one inner wall that may be used as stoppers for the American housing.

In some embodiments, the non-through section of the second European-profile-shaped through bore forms an inner wall that may be used as a stopper for the cylinder-lock member.

In some embodiments, the cylinder-lock assembly further includes a protective plate.

In some embodiments, the cylinder-lock assembly further includes a protective plate and a roseta.

In some embodiments, the lateral slit partially overlaps with the first-key-receiving-slit.

In some embodiments, the lateral slit does not overlap with the first-key-receiving-slit.

In some embodiments, an additional lateral slit is formed at the second circular end of the cylindrical shaft.

Optionally, after the American housing is inserted into the first cylindrical through bore, American housing is secured in position by an attaching means such as at least one screw.

In some embodiments, the cylinder-lock assembly further includes an electronic system for indicating whether the cylinder, the cylindrical shaft or the key-receiving-and-rotation-conveyor have been rotated.

In some embodiments, the electronic system includes a marker and a sensor. The marker is securely disposed on or proximal to the external surface of a rotatable member at a respective marker location, the rotatable member being, for example, the rotation-conveyor or the key-receiving-and-rotation-conveyor. The sensor is disposed inside the non-rotating body of the cylinder-lock, proximal to the external surface of the rotatable member, wherein the marker is radially aligned with the sensor. The rotatable member is, for example, the cylinder member or the mortise-housing-adaptor.

In some embodiments, the electronic system further including a processor and indication means, wherein the indication means is operationally connected to the sensor and to the processor. When the rotatable member is rotated, the alignment between the marker and the sensor is broken, to thereby turn ON the indication means by the processor.

The sensor may be made as a reed switch.

The sensor may be made as Hall sensors.

An embodiment is an example or implementation of the invention. The various appearances of "one embodiment", "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "one embodiment", "an embodiment", "some embodiments" or "other embodiments" means that a particular feature, structure, or characteristic described in connection with the embodiments is included in at least one embodiment, but not necessarily all embodiments of the invention. It is understood that the phraseology and terminology employed herein is not to be construed as limiting and are for descriptive purposes only.

Unless otherwise defined herein, all technical and/or scientific terms used herein have the same meaning as commonly understood by one of ordinary skill in the art to which the invention pertains. Although methods and materials similar or equivalent to those described herein may be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art as to how embodiments of the invention may be practiced.

Attention is now directed to the drawings, where like reference numerals or characters indicate corresponding or like components. In the drawings:

FIGS. 2*a* and 2*b* (prior art) is a side view illustration of a standard European profile cylinder lock.

FIG. 3 is a side view illustration of a European profile cylinder lock, wherein the portion annotated by AA' is cut off and removed from the cylinder housing shown in FIG. 2, including the locking-cam, according to embodiments of the present invention.

DESCRIPTION OF THE PREFERRED EMBODIMENTS

Figure 1A:
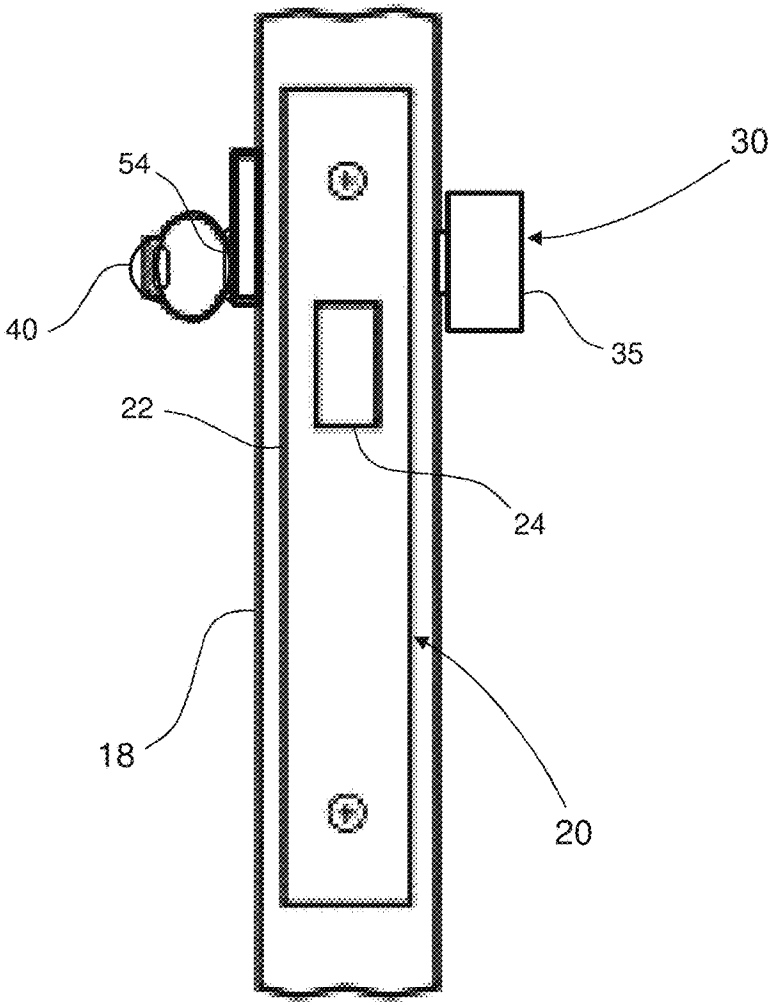
Fig 1a Prior art
FIGS. 1*a* and 1*b* (prior art) illustrate a typical knob/key operated American-cylinder operated mortise lock assemblies.
Figure 1B:
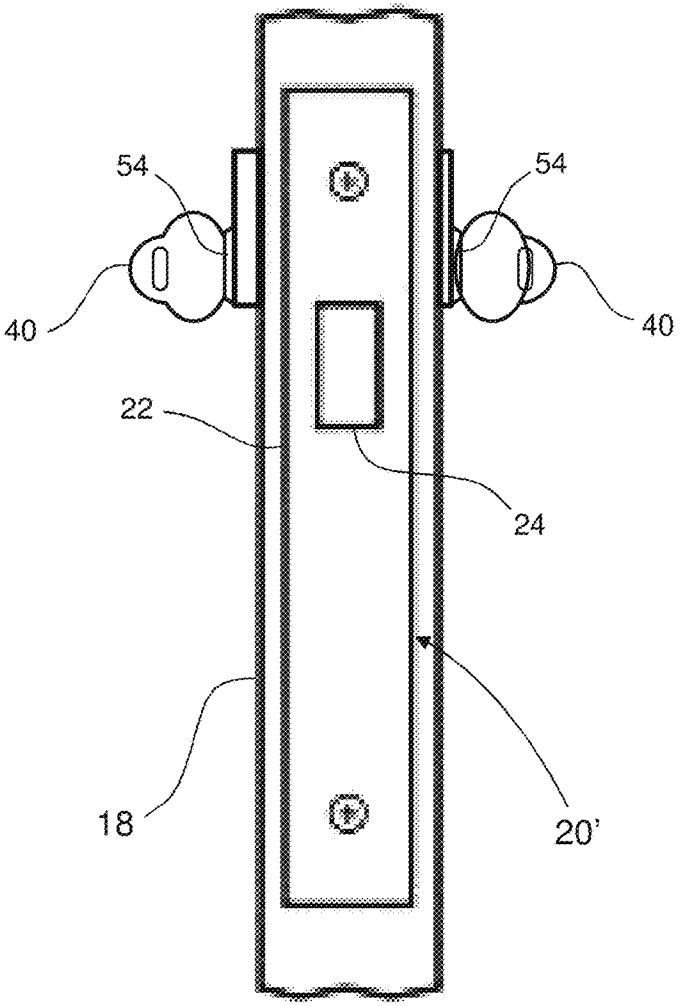
Fig 1b Prior art

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

The present invention provides cylinder-lock assembly configured to allow affixing accessories, that are designed to be operatively coupled with a European profile cylinder, to operate an American cylinder type mortise lock. The cylinder-lock assembly includes the key mechanism, wherein the rotational motion of the key is conveyed to the American type cylinder mortise lock by the cylinder lock assembly of the present invention.

As used herein, the singular form "a", "an" and "the" include plural references unless the context clearly dictates otherwise.

The word "exemplary" is used herein to mean "serving as an example, instance or illustration." Any embodiment described as "exemplary" is not necessarily to be construed as preferred or advantageous over other embodiments and/or to exclude the incorporation of features from other embodiments.

It is appreciated that certain features of the invention, which are, for clarity, described in the context of separate embodiments, may also be provided in combination or in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Reference is now made to FIG. 3, which is a side view illustration of a cylinder-lock-member 110, wherein the portion annotated by AA' is cut off from a standard cylinder housing 30 and removed, including locking-cam 36, according to embodiments of the present invention. A cylindrical shaft such as cylindrical shaft 38, and a standard key mechanism (not shown) remain in place.

Figure 4A:
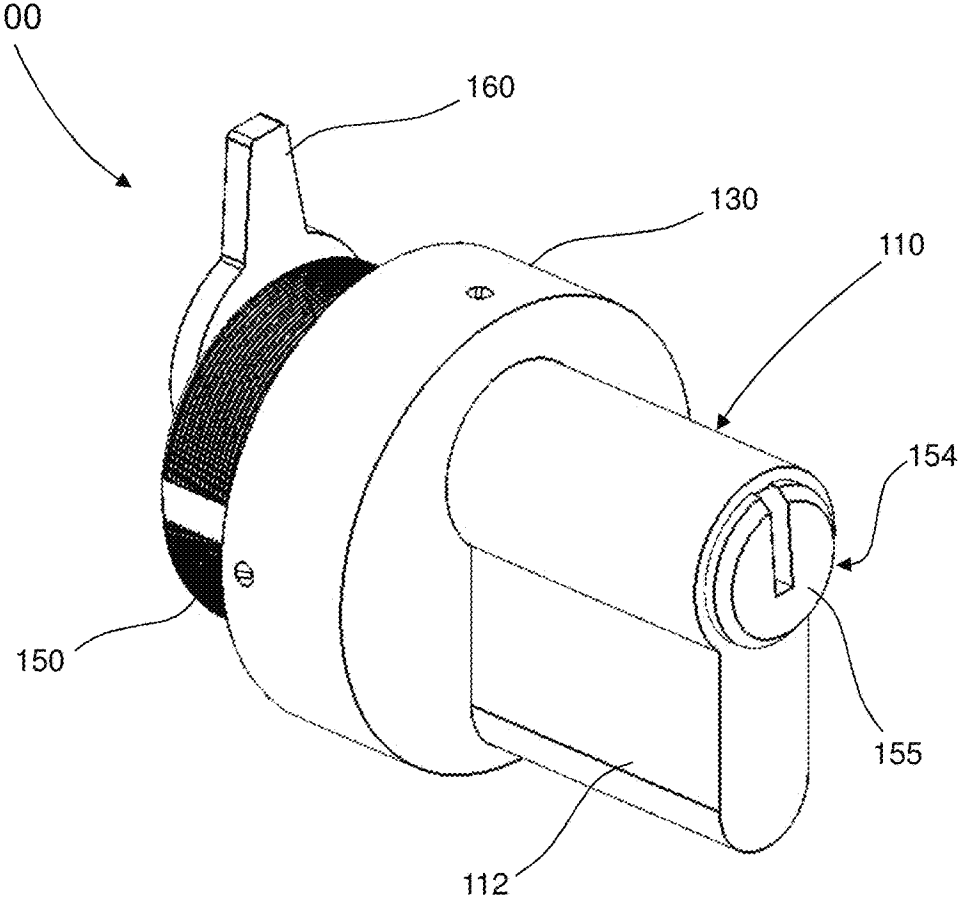
FIG. 4*a* is a front elevated perspective view illustration of an assembled cylinder-lock, according to embodiments of the present invention.
Figure 4B:
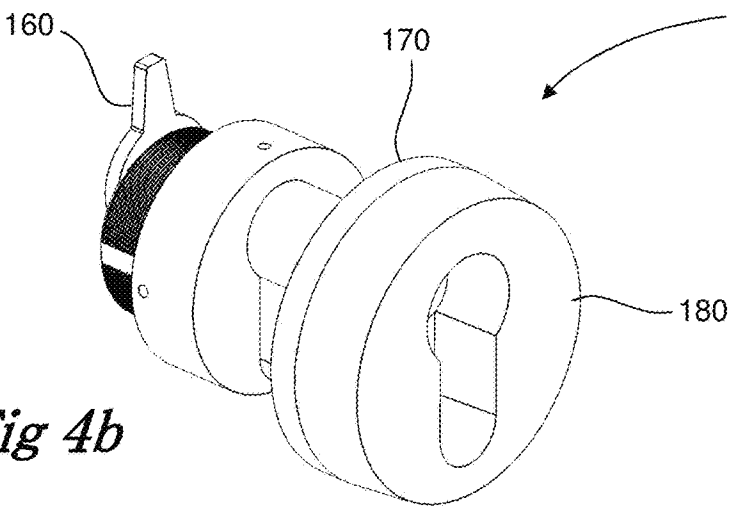
FIG. 4*b* is a front elevated perspective view illustration of an assembled cylinder-lock, as shown in FIG. 4*a*, wherein a protective plate and a roseta have been added.
Figure 4C:
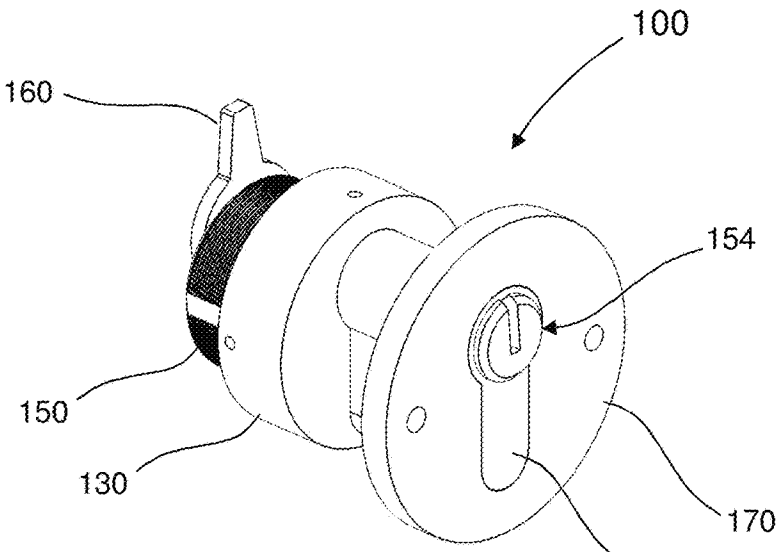
FIG. 4*c* is a front elevated perspective view illustration of an assembled cylinder-lock, as shown in FIG. 5*a*, wherein a protective plate has been added.
Figure 5A:
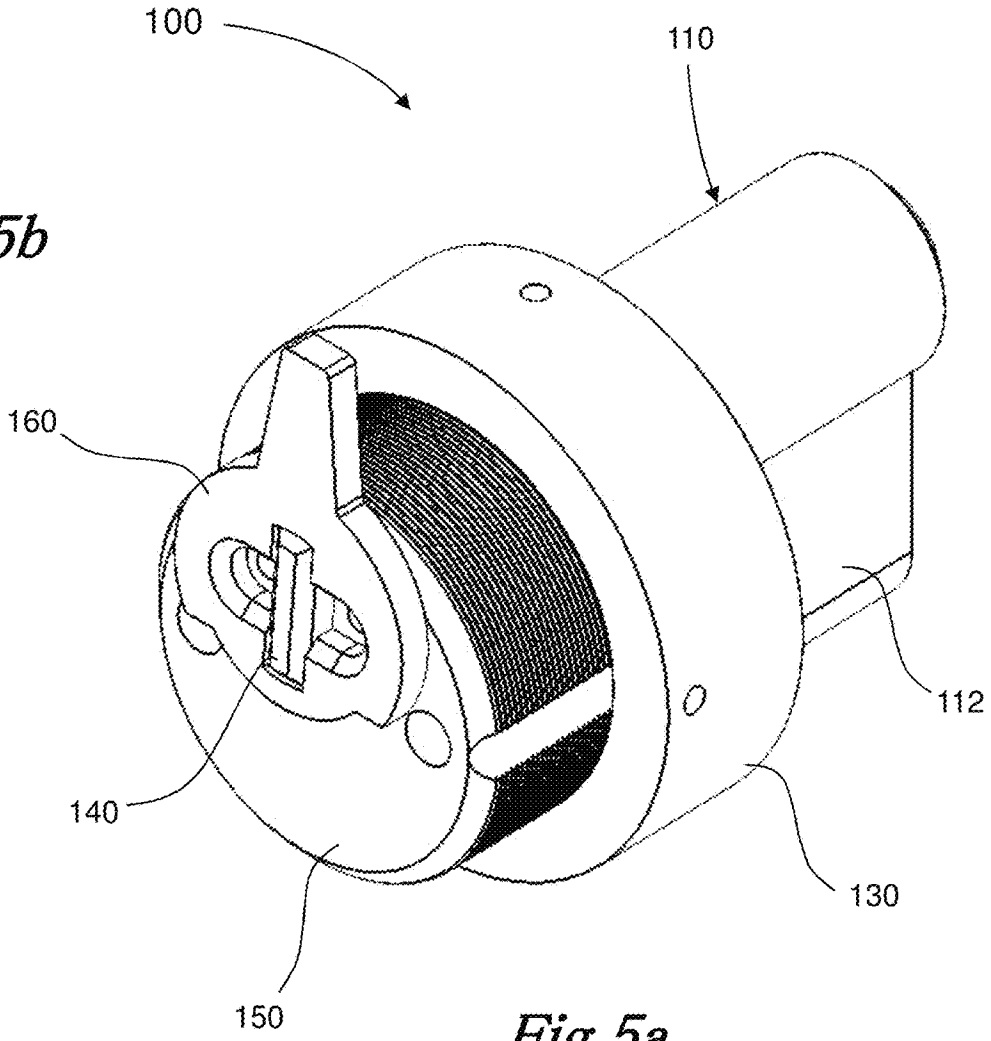
FIG. 5*a* is a rear elevated perspective view illustration of an assembled cylinder-lock, according to embodiments of the present invention.
Figure 5B:
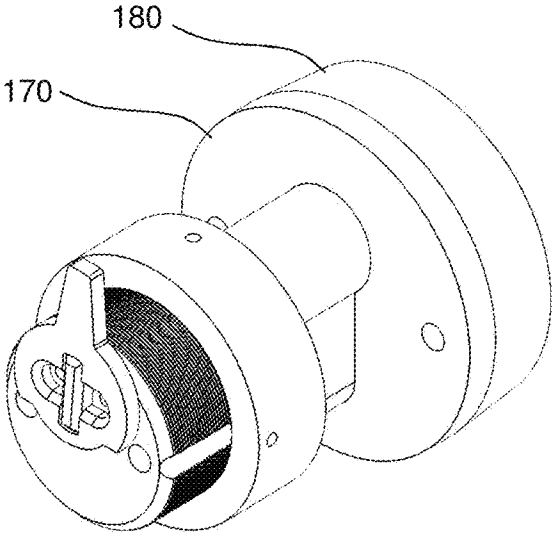
FIG. 5*b* is a rear elevated perspective view illustration of an assembled cylinder-lock, as shown in FIG. 5*a*, wherein a protective plate and a roseta have been added.
Figure 5C:
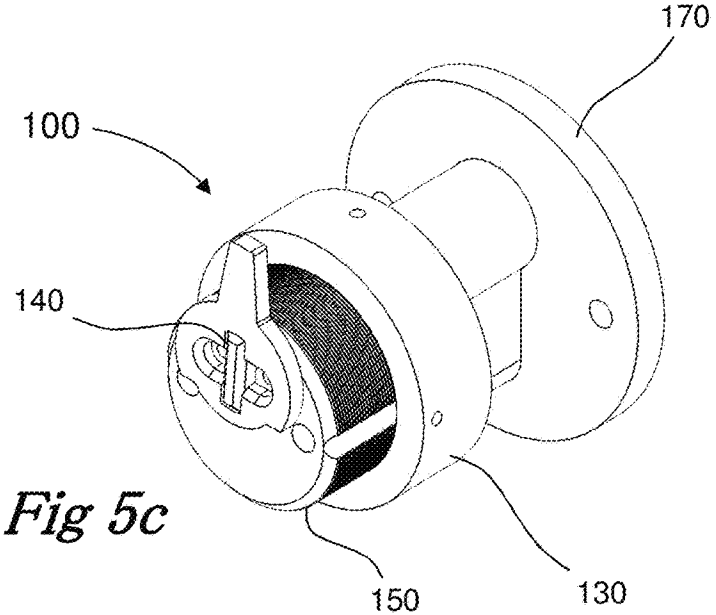
FIG. 5*c* is a rear elevated perspective view illustration of an assembled cylinder-lock, as shown in FIG. 5*a*, wherein a protective plate has been added.

Reference is also made to FIG. 4*a*, showing a front elevated perspective view illustration of an exemplary embodiment of a cylinder-lock 100, shown in an assembled state, according to embodiments of the present invention; FIG. 4*b* is a front elevated perspective view illustration of assembled cylinder-lock 100, wherein a protective plate 170 and a roseta plate 180 have been added; and FIG. 4*c* is a front elevated perspective view illustration of an assembled cylinder-lock 100, wherein just a protective plate 170 has been added. FIG. 5*a* is a rear elevated perspective view illustration of an assembled cylinder-lock 100; FIG. 5*b* is a rear elevated perspective view illustration of an assembled cylinder-lock 100, wherein a protective plate 170 and a roseta plate 180 have been added; FIG. 5*c* is a rear elevated perspective view illustration of an assembled cylinder-lock 100, wherein a protective plate 170 has been added.

Figure 6A:
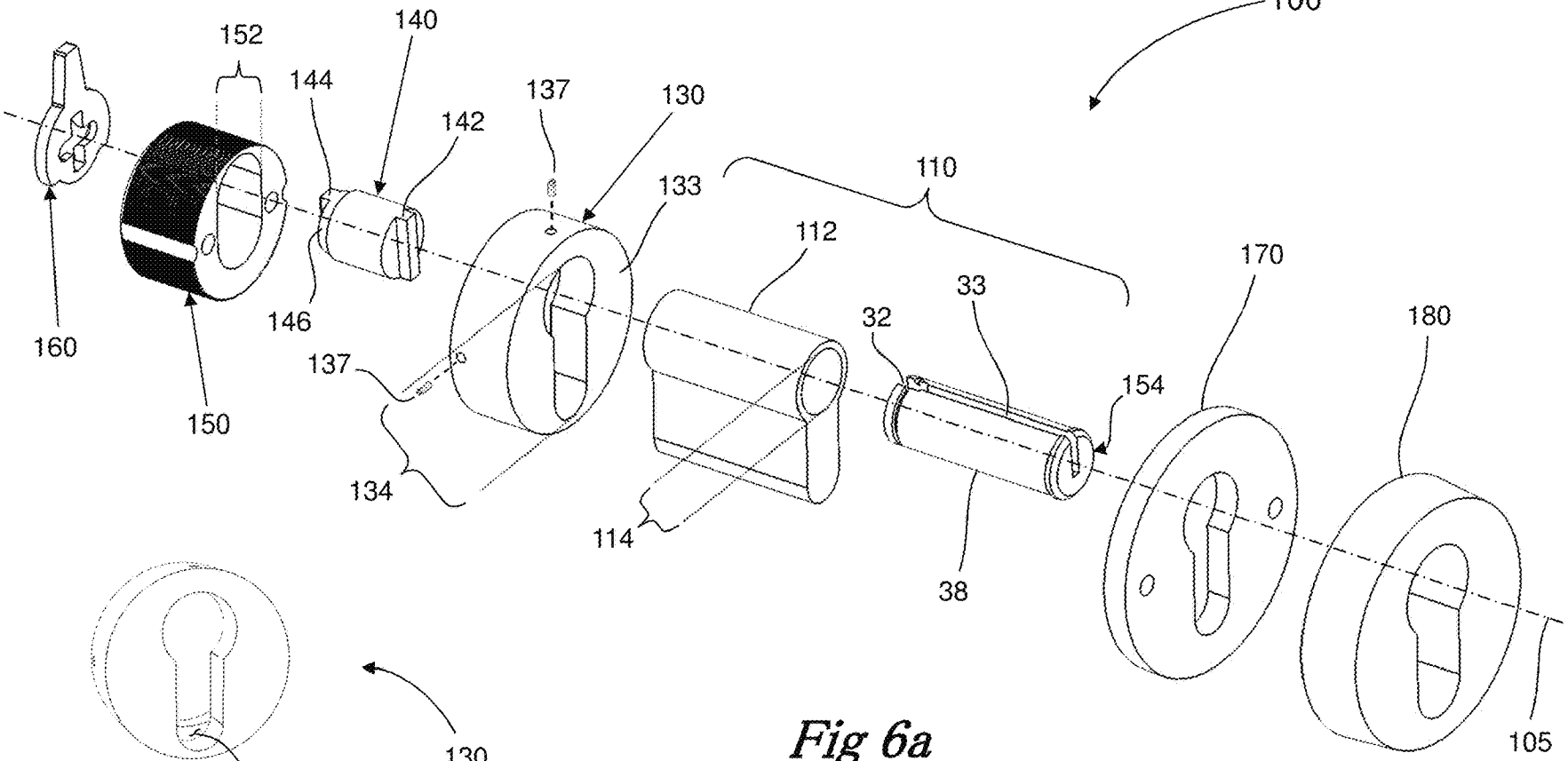
FIG. 6*a* is an exploded, front elevated perspective view illustration of the cylinder-lock, as shown in FIG. 4*b*.
Figures 7A, 7B:
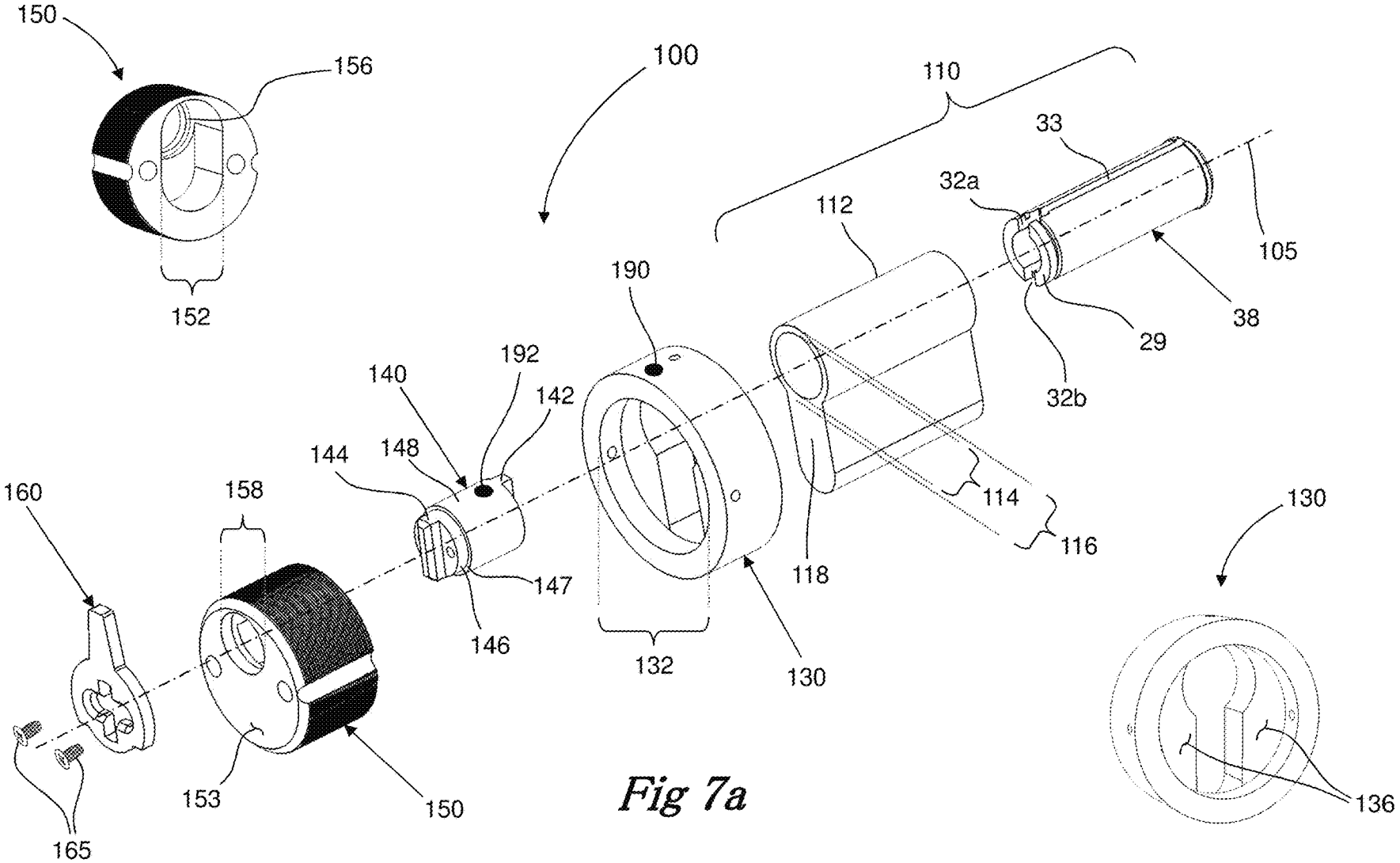
FIG. 7*a* is an exploded, rear elevated perspective view illustration of cylinder-lock, as shown in FIG. 5*a*.
FIG. 7*b* is a rear perspective view illustration of the adapting-ring.

Reference is also made to FIG. 6*a*, showing an exploded, front elevated perspective view illustration of cylinder-lock 100; and FIG. 7*a* shows an exploded, rear elevated perspective view illustration of cylinder-lock 100.

The kit that composes cylinder-lock 100 includes a cylinder-lock-member 110, an adapting-ring 130, a rotation-conveyor 140, an American-lock-housing-member 150 and an American-lock cam 160.

Cylinder-lock-member 110 includes a cylinder-housing 112 that has an external profile shape that is the same as that of the standard European profile shape (see FIG. 2*b*). Cylinder-housing 112 includes a cylindrical shaft, such as cylindrical shaft 38, and a standard key engagement mechanism (not shown). Cylinder-housing 112 defines there within a cylindrical through bore 114, configured to receive cylindrical shaft 38 that is adapted to rotate inside bore 114 of cylinder-housing 112.

When a fitted key 40 is inserted into the key-receiving-slit 33 to operably engage with the engagement mechanism, the turn of the key also turns the cylindrical shaft 38 inside cylinder-housing 112 about rotational axis 105. It should be noted that a through lateral slit 32 is formed at the opposite side end 29 of the cylindrical shaft 38.

Figure 8:
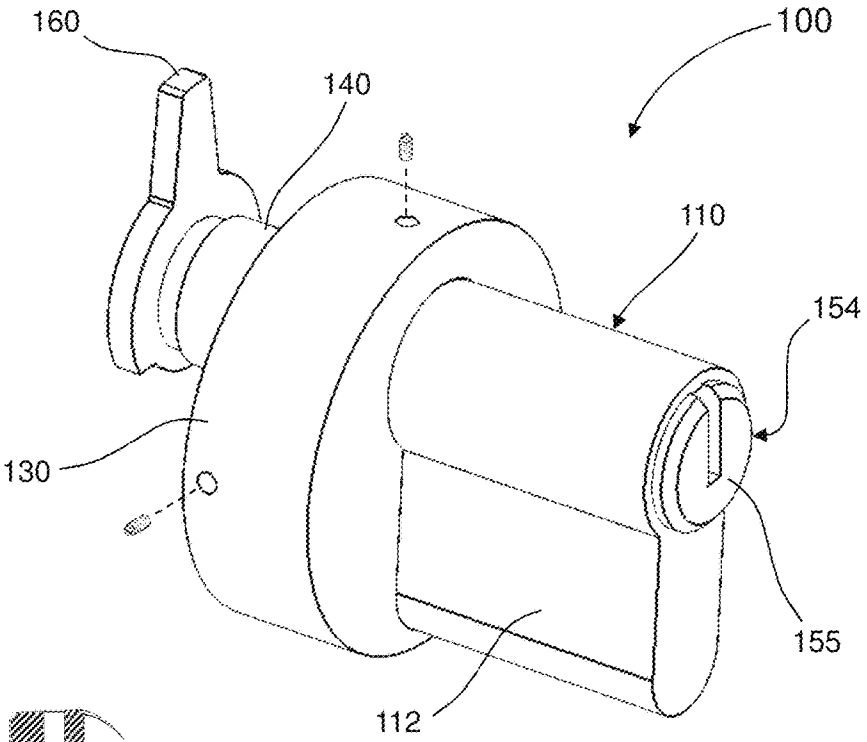
FIG. 8 is a front elevated perspective view illustration of the assembled cylinder-lock, as shown in FIG. 4*a*, wherein the American-lock housing is removed for illustrative purposes only.
Figure 9A:
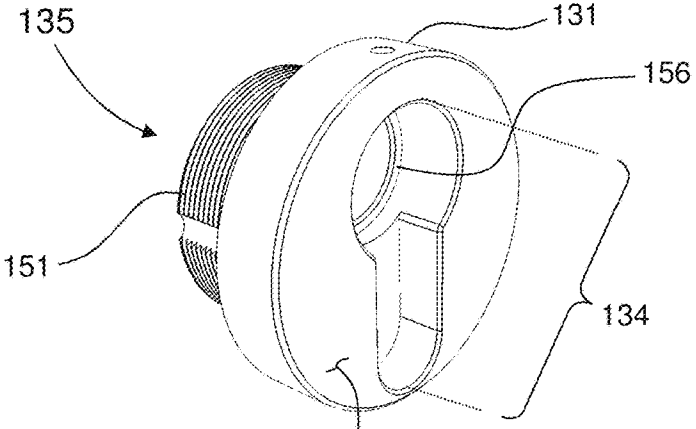
FIG. 9*a* is a front elevated perspective view illustration of a one-piece mortise housing adaptor, according to some embodiments of the present invention.
Figure 9B:
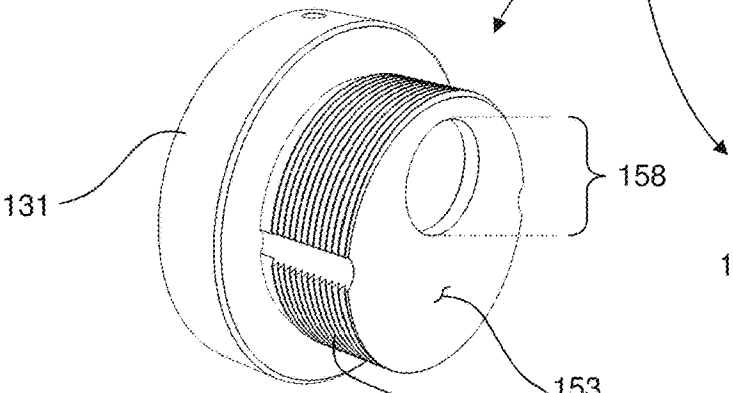
FIG. 9*b* is a rear elevated perspective view illustration of the one-piece mortise housing adaptor shown in FIG. 9*a*.
Figure 9C:
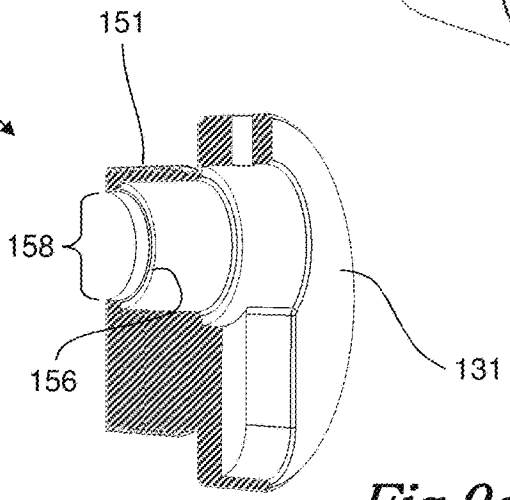
FIG. 9*c* is a cross-sectioned, front perspective view illustration of the one-piece mortise housing adaptor shown in FIG. 9*a*.
Figure 10A:
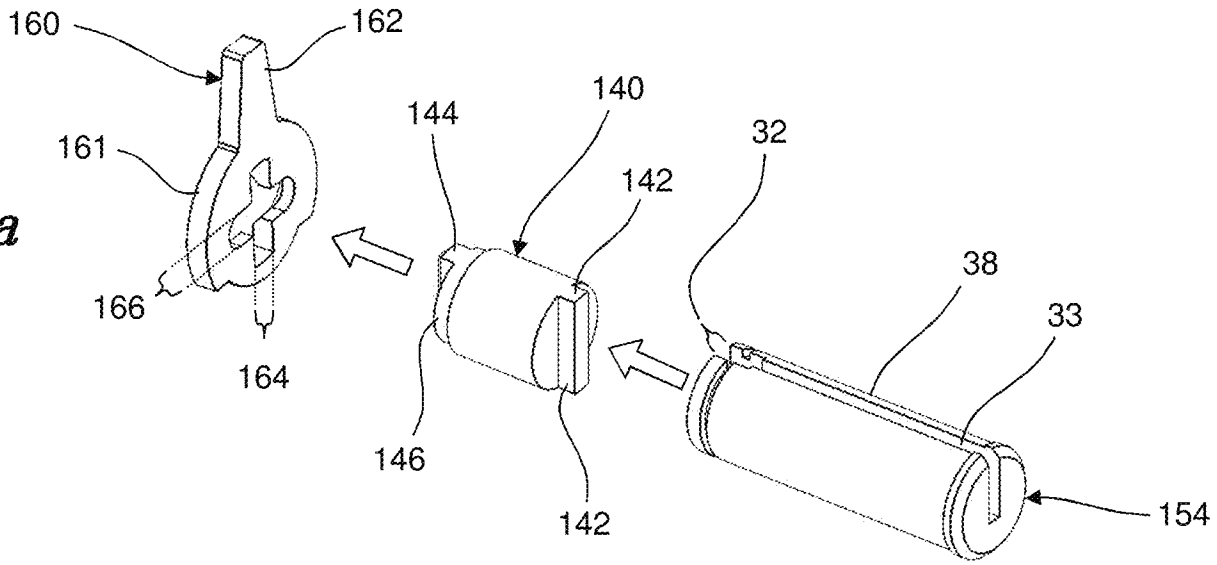
FIG. 10*a* is an exploded front elevated perspective view illustration of the American-lock cam, the European shaft, and the rotation-conveyor, illustrating the engagement assembly of these parts.
Figure 10B:
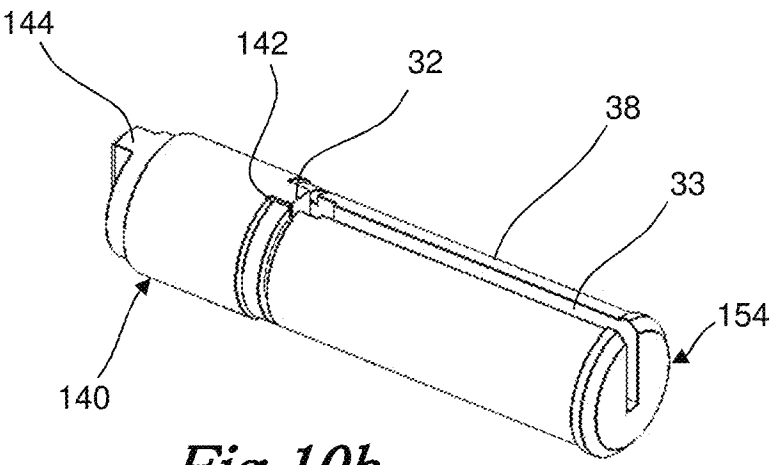
FIG. 10*b* is a front elevated perspective view illustration of the European shaft, and the rotation-conveyor, being in the engaged state of these parts.
Figure 10C:
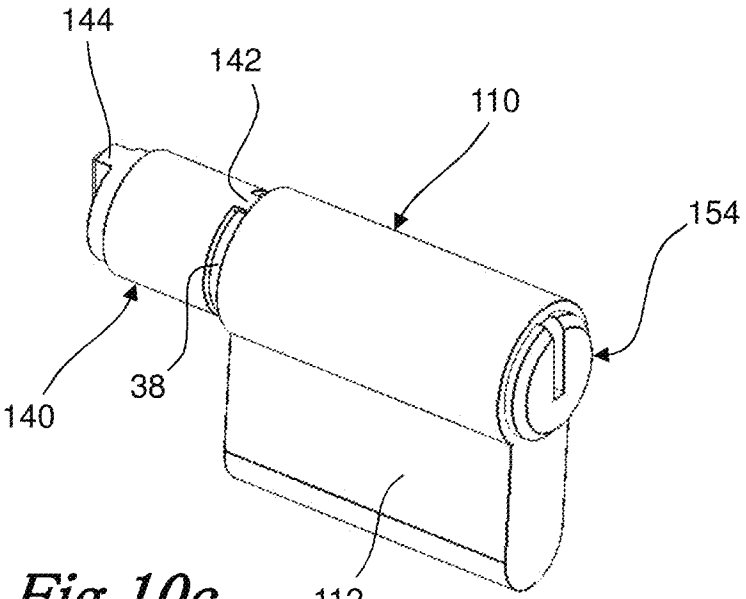
FIG. 10*c* is a front elevated perspective view illustration of the cylinder lock member, the cylinder shaft, and the rotation-conveyor, wherein all parts are in the engaged state.

Reference is also made to FIG. 8, showing a front elevated perspective view illustration of the assembled cylinder-lock 100, as shown in FIG. 4*a*, wherein the American-lock-housing-member 150 has been removed for illustrative purposes only; to FIG. 9*a*, showing a front elevated perspective view illustration of a one-piece mortise-housing-adaptor 135; FIG. 9*b*, showing a rear elevated perspective view illustration of a one-piece mortise-housing-adaptor 135; to FIG. 9*c*, showing a cross-sectioned, front perspective view illustration of a one-piece mortise-housing-adaptor 135; to FIG. 10*a*, showing an exploded front elevated perspective view illustration of the American-lock cam 160, a cylindrical shaft, such as cylindrical shaft 38, and the rotation-conveyor 140, exemplifying the engagement assembly of these parts; to FIG. 10*b*, showing a front elevated perspective view illustration of a cylindrical shaft, such as cylindrical shaft 38, and rotation-conveyor 140, wherein all these parts are in the engaged state; and to FIG. 10*c*, showing a front elevated perspective view illustration of cylinder-lock-member 110, a cylindrical shaft, such as cylindrical shaft 38 and rotation-conveyor 140, being in the engaged state with these parts, wherein all parts are in the engaged state; and to FIG. 11, showing three example variations of cylinder shafts 38 of the cylinder-lock-member.

American-lock-housing-member 150 is typically cylindrical, having the dimensions of a standard American cylindrical lock housing, and defines a through cylindrical bore 158 (see FIG. 7*a*). Through cylindrical bore 158 is configured to receive a rotation-conveyor 140. Through cylindrical bore 158 is offset from the central axis of American-lock-housing-member 150, which axis of through cylindrical bore 158 coincides with rotational axis 105. The diameter of American-lock-housing-member 150 allows American-lock-housing-member 150 to fit in a preconfigured orifice defined in the American type mortise lock housing.

Rotation-conveyor 140 is configured for insertion into American-lock-housing-member 150. Rotation-conveyor 140 includes a cylindrical body 148, a first end and a second circular end, having a cylindrical-end-portion 146 proximal to the second circular end, wherein the first end defines a first rectangular protruding portion 142 and the second end defines a second rectangular protruding portion 144. The diameter of cylindrical body 148 is slightly larger than cylindrical-end-portion 146, thereby forming a bench 147 (see FIG. 7*a*) at the boundary line formed where the two external surfaces of cylindrical body 148 and cylindrical-end-portion 146 meet.

Through bore 158 is configured to fittingly receive cylindrical-end-portion 146 of rotation-conveyor 140. It should be noted that the orientation of first rectangular protruding portion 142 and second rectangular protruding portion 144 are preconfigured and, typically, first rectangular protruding portion 142 and second rectangular protruding portion 144 are parallel, having the same orientation.

Adapting-ring 130 defines a first cylindrical through bore 132 (see FIG. 7*a*) on a first side, and a second European-profile-shaped through bore 134 (see FIG. 6*a*) on the second side, wherein first cylindrical through bore 132 and second European-profile-shaped bore 134 are preferably partially through bores, and wherein second European-profile-shaped through bore 134 is configured to receive cylinder-housing 112 of cylinder-lock-member 110. First cylindrical through bore 132 is configured to receive American-lock-housing-member 150. Typically, since the elongated dimension of the European profile is longer than the external diameter of American-lock-housing-member 150, an inner wall segment is formed at the meeting plane of first cylindrical through bore 132 (see FIG. 7*a*) on a first side, and a second European-profile-shaped through bore 134, wherein that wall segment serve as a stopper for cylinder-lock-member 110, when inserted into European-profile-shaped through bore 134. Similarly, since the narrow dimension of the European profile is narrower than the external diameter of American-lock-housing-member 150, another one or more inner wall segments formed at the meeting plane of first cylindrical through bore 132 (see FIG. 7*a*) on a first side, and a second European-profile-shaped through bore 134, wherein these one or more wall segments serve as stoppers for American-lock-housing-member 150, when inserted into first cylindrical through bore 132.

Figure 6B:
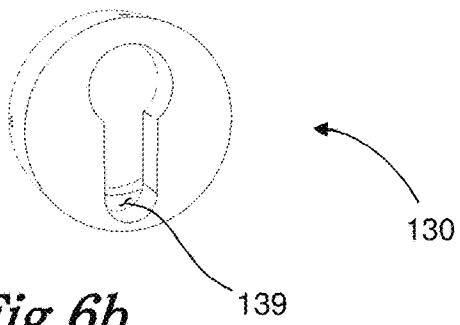
FIG. 6*b* is a front perspective view illustration of the adapting-ring.

It should be noted that first cylindrical through bore 132 includes a non-through sections, wherein the non-through sections of first cylindrical through bore 132 form inner walls 136 (see FIG. 7*b*) that are used as stoppers for American-lock-housing-member 150. Similarly, second European-profile-shaped through bore 134 includes a non-through sections, wherein the non-through sections of second European-profile-shaped through bore 134 forms at least one inner wall 139 (see FIG. 6*b*) that is used as a stopper for cylinder-lock-member 110.

In variations of the present invention, adapting-ring 130 and American-lock-housing-member 150 are combined into a one-piece mortise-housing adaptor 135 (see FIGS. 9*a* and 9*b*), having an adapting-ring portion 131 and an American housing portion 151. The European-side-face 133 of mortise-housing adaptor 135 remains as European-side-face 133 of adapting-ring 130. Similarly, the American-side-face 153 of mortise-housing adaptor 135 remains as American-side-face 153 of American-lock-housing-member 150.

Typically, after American-lock-housing-member 150 is inserted into first cylindrical through bore 132, American-lock-housing-member 150 is secured in position, for example by a screw 137 (see FIG. 6*a*). Similarly, after cylinder-lock-member 110 is inserted into second European-profile-shaped through bore 134, cylinder-lock-member 110 is secured in position, for example by a screw 137 (see FIG. 6*a*).

An American-lock cam 160 is configured for coupling to rotation-conveyor 140. American-lock cam 160 includes a cam arm 162 and a body 161 having a rectangular opening 164 formed therein, to receive the rectangular protruding portion 144 of rotation-conveyor 140. Typically, another one or more openings 166 are formed in body 161 configured to receive one or more fasteners 165, to thereby secure rotation-conveyor 140 to American-lock cam 160.

There are several sequences in which cylinder-lock 100 may be assembled. In one exemplary sequence of assembling cylinder-lock 100, rotation-conveyor 140 is inserted partially through bore 152 formed in the second side of American-lock-housing-member 150, with respect to through cylindrical bore 158, wherein cylindrical-end-portion 146 is fitted inside through cylindrical bore 158 of American-lock-housing-member 150, while partially through bore 152 is configured to accommodate cylindrical body 148, of rotation-conveyor 140. Through cylindrical bore 158 is formed such that its inner hollow space fully overlaps with the inner hollow space of partially through bore 152, forming a bench 156 (see FIGS. 9*a* and 9*c*). Second rectangular protruding portion 144 is inserted into rectangular opening 164 of American-lock cam 160 (see FIG. 10*a*), and American-lock cam 160 is then securely attached to rotation-conveyor 140. Next, American-lock-housing-member 150 is inserted through first cylindrical through bore 132 of adapting-ring 130. Next, cylinder-lock-member 110 is inserted through second European-profile-shaped through bore 134 of adapting-ring 130. Typically, adapting-ring 130 is then securely attached to American-lock-housing-member 150 and/or cylinder-lock-member 110. Cylinder-lock 100 is now assembled as shown in FIGS. 4*a* and 5*a*.

Cylinder-lock-member 110 is operable from a key engagement hand side 155 of the cylindrical lock core 154 by a fitted key 40. When key 40 is turned, the key teeth engage features within the key mechanism (not shown) inside cylinder-lock-member 110, to allow rotation of the cylindrical shaft 38 about rotational axis 105, and thereby the rotation of rotation-conveyor 140, and thereby the rotation of a cam, such as a standard American-lock cam 160 (herein after referred to, with no limitations, as American-lock cam 160), and thereby operate the locking mechanism (not shown) within the American cylinder type mortise lock (not shown).

Figure 11B:
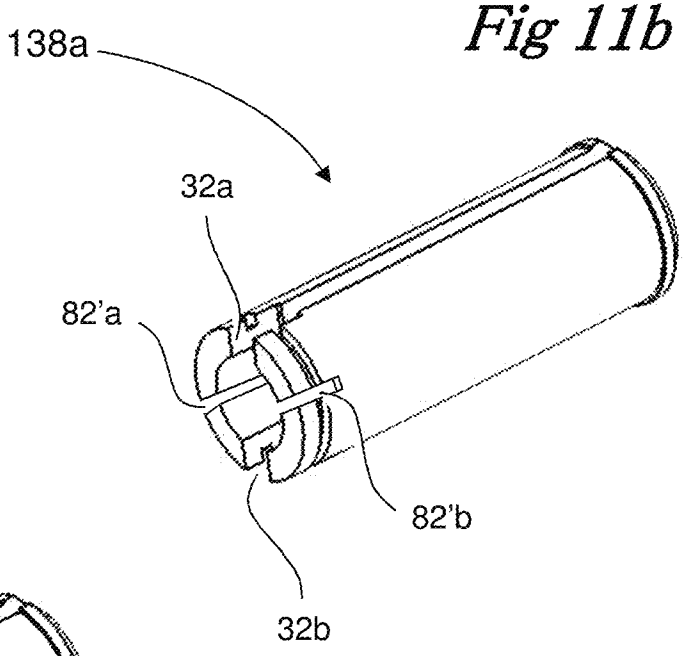
FIGS. 11*a*-11*c* illustrate three example variations of cylinder shafts of the cylinder-lock-member.
Figure 11A:
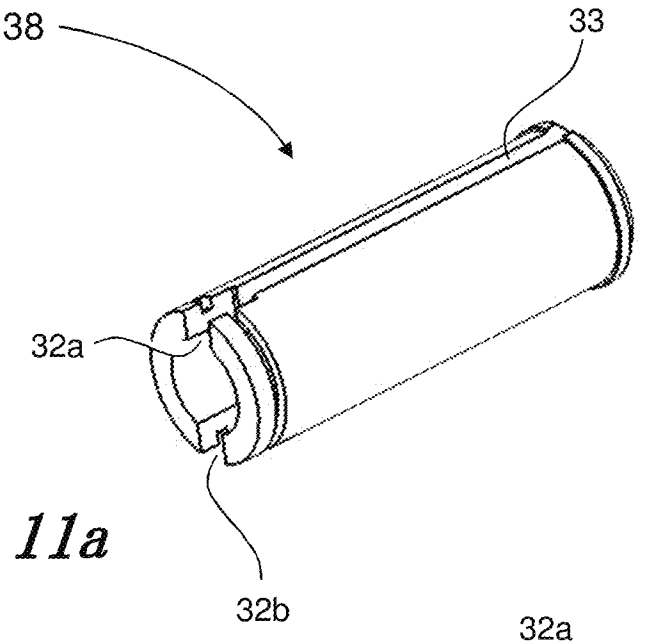
Figure 11C:
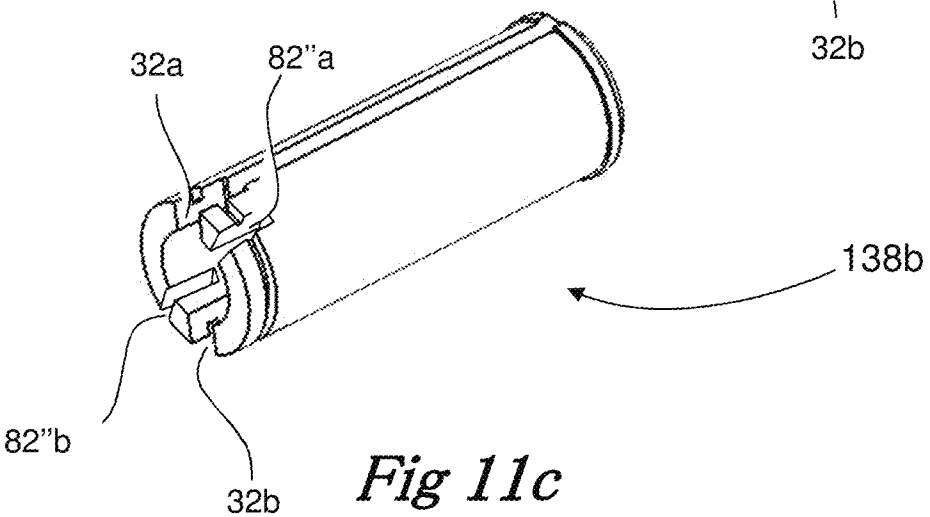

Reference is now also made to FIGS. 11*a*-11*c*, illustrating three example variations of cylinder shafts 38, 138*a* and 138*b* of a cylinder-lock-member 110. In cylinder shaft 38, as shown in FIG. 11*a*, through lateral slit 32, denoted as the combination of slits 32*a* and 32*b*, is aligned with the longitudinal key-receiving-slit 33, wherein slit 32*a* overlaps key-receiving-slit 33. When the length of a key 40 exceeds the length of key-receiving-slit 33 and enters the space of slit 32*a*, key 40 may bump into first rectangular protruding portion 142 that is operatively disposed inside said lateral slit 32. Therefore, in some embodiments, through lateral a slit 82 is formed such that slit 82 does not overlap with key-receiving-slit 33. In one example of a cylinder shafts 138*a*, as shown in FIG. 11*b*, through lateral slit 82' (82'*a* combined with 82'*b*) is formed perpendicular to key-receiving-slit 33. In another example of a cylinder shafts 138*b*, as shown in FIG. 11*c*, through lateral slit 82" (82"*a* combined with 82"*b*) is formed diagonally with respect to key-receiving-slit 33.

The converted cylinder lock 100 may further include a protective plate 170 and/or a roseta 180 (see FIGS. 4*b*, 4*c*, 5*b*, 5*c* and 6).

Figure 12:
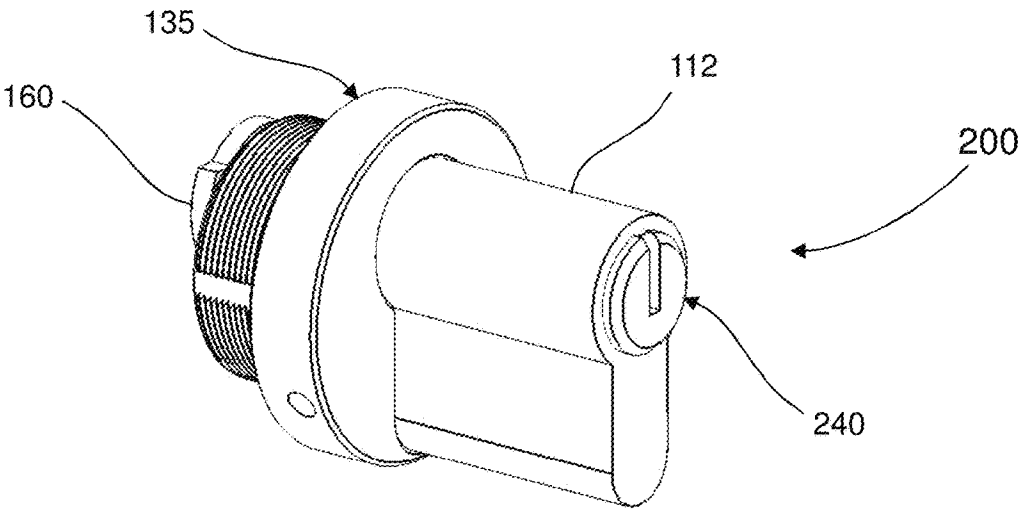
FIG. 12 is a front elevated perspective view illustration of another cylinder-lock, according to some embodiments of the present invention.
Figure 13A:
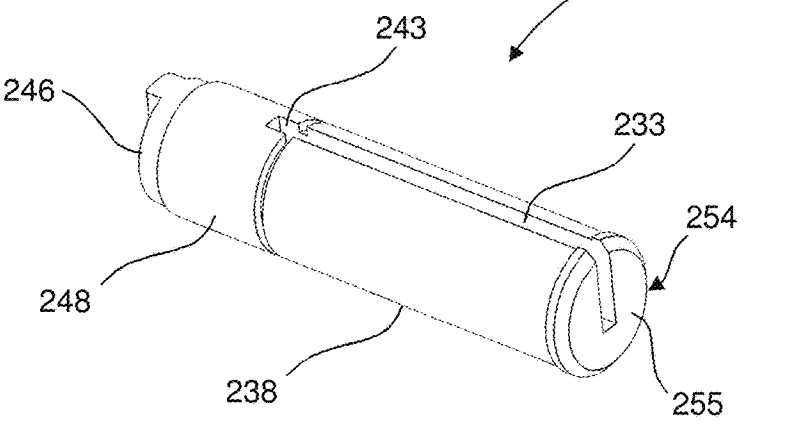
FIG. 13*a* is a front elevated perspective view illustration of a one-piece key-receiving-and-rotation-conveyor, according to some embodiments of the present invention.
Figure 13B:
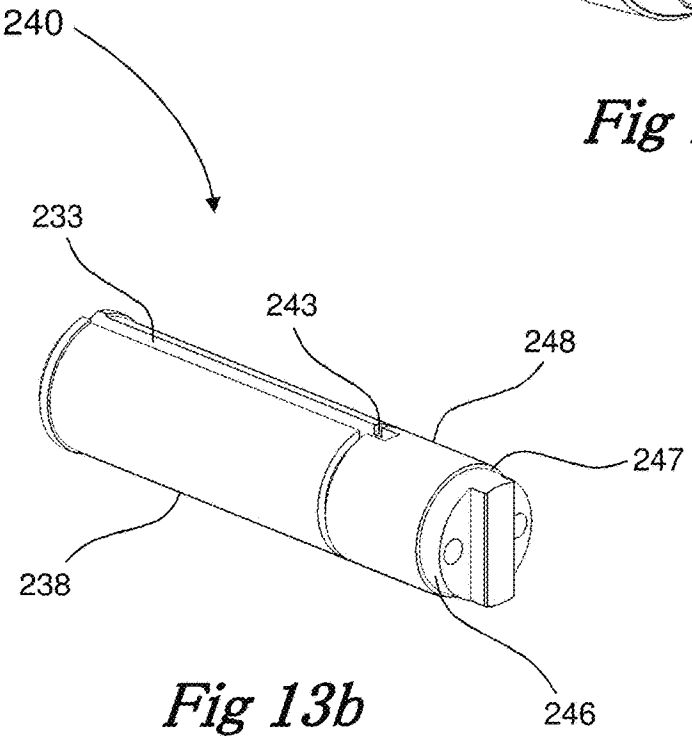
FIG. 13*b* is a rear elevated perspective view illustration of the one-piece key-receiving-and-rotation-conveyor, as shown in FIG. 13*a*.

Reference is also made to FIG. 12, showing a front elevated perspective view illustration of an exemplary embodiment of a cylinder-lock 200, shown in an assembled state, according to embodiments of the present invention. Cylinder-lock 200 is similar to cylinder-lock 100, whereas in cylinder-lock 200 cylindrical shaft 38 and rotation-conveyor 140 are embodied as a single unit 240 as shown in FIGS. 13*a* and 13*b*, wherein FIG. 13*a* illustrates a front elevated perspective view of a one-piece key-receiving-and-rotation-conveyor 240, according to some embodiments of the present invention, and FIG. 13*b* illustrates a rear elevated perspective view of the one-piece key-receiving-and-rotation-conveyor 240.

Key-receiving-and-rotation-conveyor 240 includes a cylindrical shaft section 238 and rotation-conveyor section 248. Cylindrical shaft section 238 fulfils the same functions as does cylindrical shaft 38 of cylinder-lock 100. Cylindrical shaft section 238 includes a key-receiving-slit 233 configured to receive a fitted key 40, having a specific fitting code, and a key verification mechanism (not shown) for verifying the key fitting code.

Rotation-conveyor section 248 is functionally similar to rotation-conveyor 140, wherein rotation-conveyor section 248 is fused with cylindrical shaft section 238 rather than being detachably engaged with cylindrical shaft section 238. Rotation-conveyor section 248 includes an open circular end, having a cylindrical-end-portion 246, similar to cylindrical-end-portion 246, disposed proximal to the circular end, wherein the circular end of rotation-conveyor section 248 defines a rectangular protruding portion 244. Cylindrical-end-portion 246 is configured to operatively fit inside through cylindrical bore 158 of American-lock-housing-member 150. The diameter of cylindrical rotation-conveyor section 248 is slightly larger than cylindrical-end-portion 246, thereby forming a bench 247 (see FIG. 13*b*) at the boundary line formed where the two external surfaces of cylindrical rotation-conveyor section 248 and cylindrical-end-portion 146 meet. Rectangular protruding portion 244 is operatively inserted into rectangular opening 164 of American-lock cam 160. Rotation-conveyor section 248 is configured to operationally rotate about rotational axis 205 of cylinder-lock 200.

It should be noted that instead of the engagement portion of rotation-conveyor 140, i.e. rectangular protruding portion 144, slit 233 is extended from front end 255 of key-receiving-and-rotation-conveyor 240, into rotation-conveyor section 248, facilitating a key 40 in which its length exceeds the length of key-receiving-slit 233 to enter the space 243 formed in rotation-conveyor section 248, enabling to receive the key end.

Figure 14:
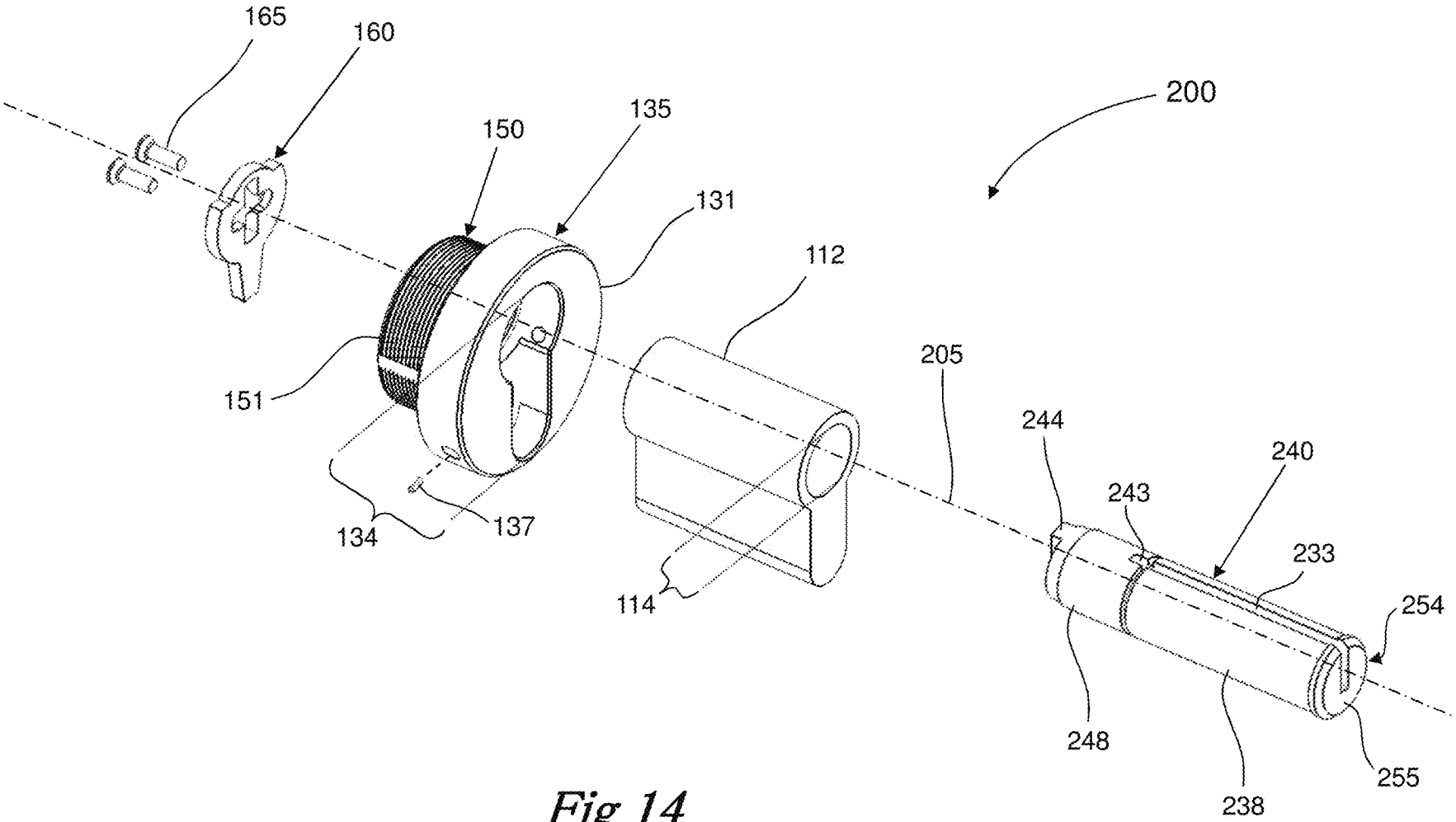
FIG. 14 is an exploded front elevated perspective view illustration of the American-lock cam, the European shaft, and the rotation-conveyor, illustrating the engagement assembly of these parts to form the cylinder-lock, as shown in FIG. 12.

Reference is also made to FIG. 14, showing an exploded, front elevated perspective view illustration of cylinder-lock 200. In this example, the kit that composes cylinder-lock 200 includes key-receiving-and-rotation-conveyor 240, cylinder-housing 112, mortise-housing-adaptor 135 and an American-lock cam 160. Cylinder-lock 200 may also include a protective plate 170 and/or a roseta plate 180. Mortise-housing-adaptor 135 may be replaced by adapting-ring 130 combined with American-lock-housing-member 150.

Figure 15:
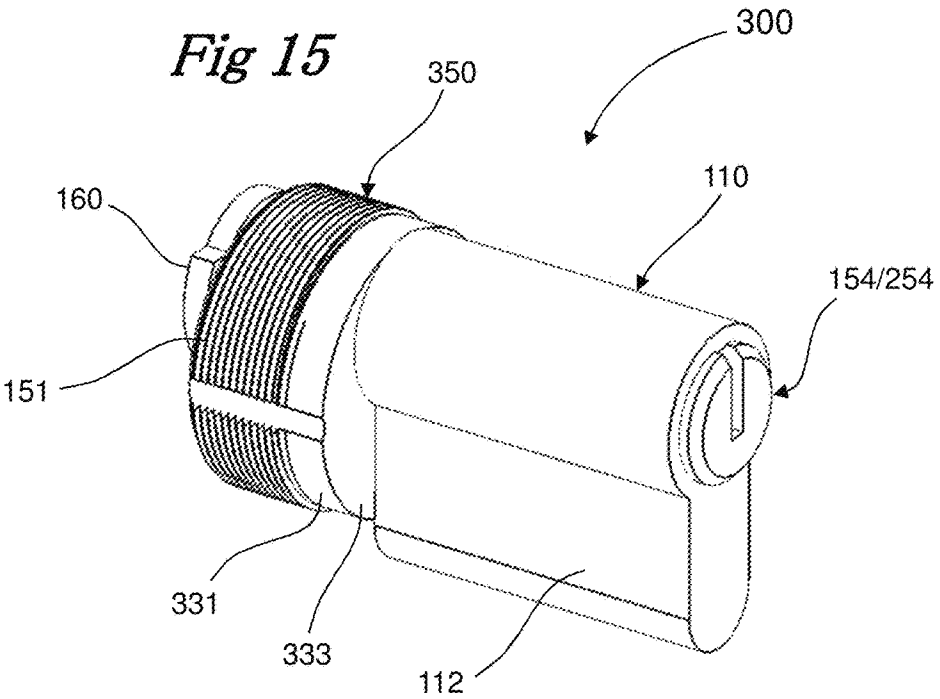
FIG. 15 is a front elevated perspective view illustration of another exemplary embodiment of a cylinder-lock, shown in an assembled state, according to variations of the present invention.
Figure 16A:
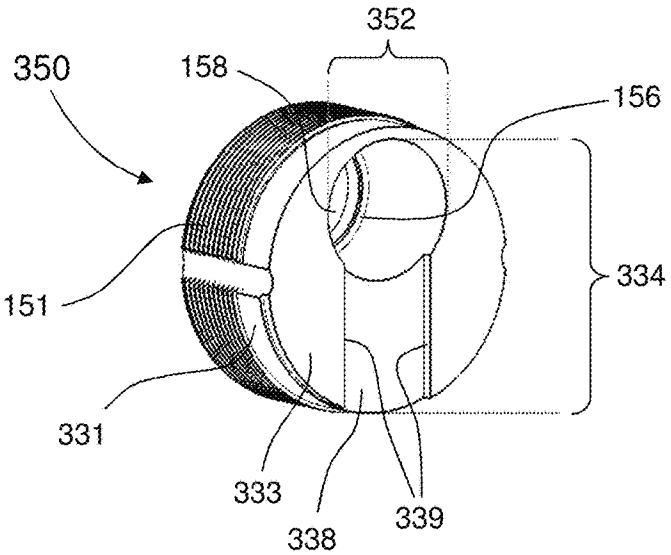
FIG. 16*a* is a front perspective view illustration of the variation of a one-piece mortise housing adaptor, as shown in FIG. 15.
Figure 16B:
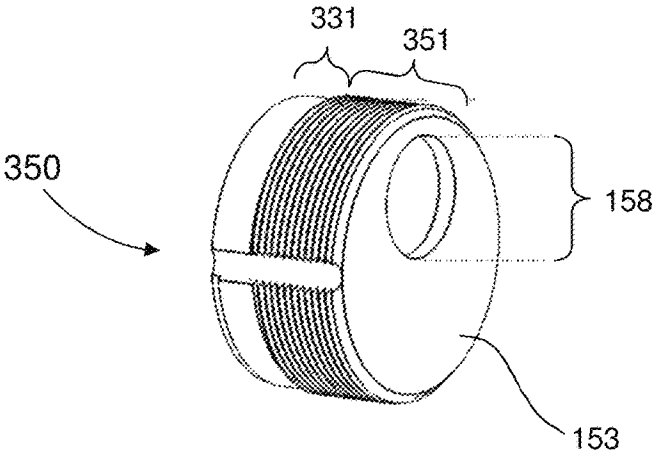
FIG. 16*b* is a rear perspective view illustration of the one-piece mortise housing adaptor shown in FIG. 16*a*.
Figure 17:
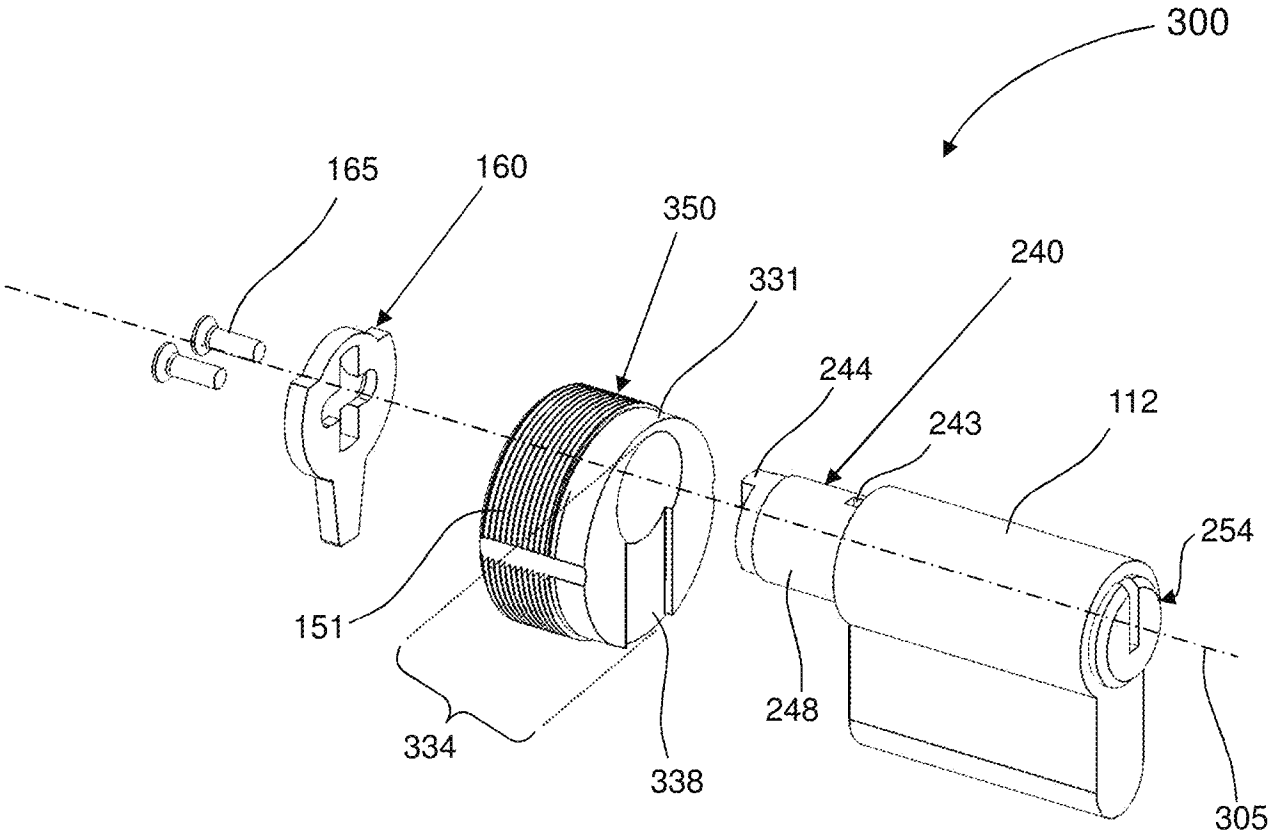
FIG. 17 is an exploded, front elevated perspective view illustration of cylinder-lock, as shown in FIG. 15.

Reference is also made to FIG. 15, showing a front elevated perspective view illustration of another exemplary embodiment of a cylinder-lock 300, shown in an assembled state, according to embodiments of the present invention. Cylinder-lock 300 is similar to cylinder-locks 100 and 200, whereas in adapting-ring 130 is then securely attached to American-lock-housing-member 150 are embodied as a single unit American-mortise-adaptor 350 as shown in FIGS. 16*a* and 16*b*, wherein FIG. 16*a* illustrates a front perspective view of a one-piece American-mortise-adaptor 350, according to some embodiments of the present invention, and FIG. 16*b* illustrates a rear perspective view of the one-piece American-mortise-adaptor 350. FIG. 17 is an exploded, front elevated perspective view illustration of cylinder-lock 300; and FIG. 18 is an exploded, rear elevated perspective view illustration of cylinder-lock 300.

In this variation of the present invention, adapting-ring 130 and American-lock-housing-member 150 are combined into a one-piece American-mortise-adaptor 350 (see FIGS. 16*a* and 16*b*), having a holding portion 331 and an American housing portion 351. The American-side-face 153 of American-mortise-adaptor 350 is similar to American-side-face 153 of American-lock-housing-member 150. However, the European-side-face 333 of American-mortise-adaptor 350 is changed, but maintains the European side functionality as that of European-side-face 133 of adapting-ring 130. Compared to mortise-housing adaptor 135, the European-side-face 333 of American-mortise-adaptor 350 is dramatically reduce in size compared to European-side-face 133 of ring 130 (or European-side-face 133 (see FIG. 9*a*) of adapting-ring portion 131 of mortise-housing adaptor 135), while maintaining the European side functionality as that of European-side-face 133 of adapting-ring 130. Practically, the diameter of profile-holding portion 331 is reduced, for example, with no limitations, to the diameter of American housing portion 151. The thickness of profile-holding portion 331 may be reduced such that what is left of the second European-profile-shaped through bore 134 of mortise-housing adaptor 135 is a European-profile-shaped-grove 334 (see FIG. 16*a*). European-profile-shaped-groove 334 is deep enough to accommodate the end portion of cylinder-housing 112 that includes housing-face 118, wherein the elongated groove portion 338 forms a pair of walls 339 with European-side-face 333, wherein said walls 339 prevent cylinder-housing 112 from pivoting, when key 40 is turned.

Figure 18:
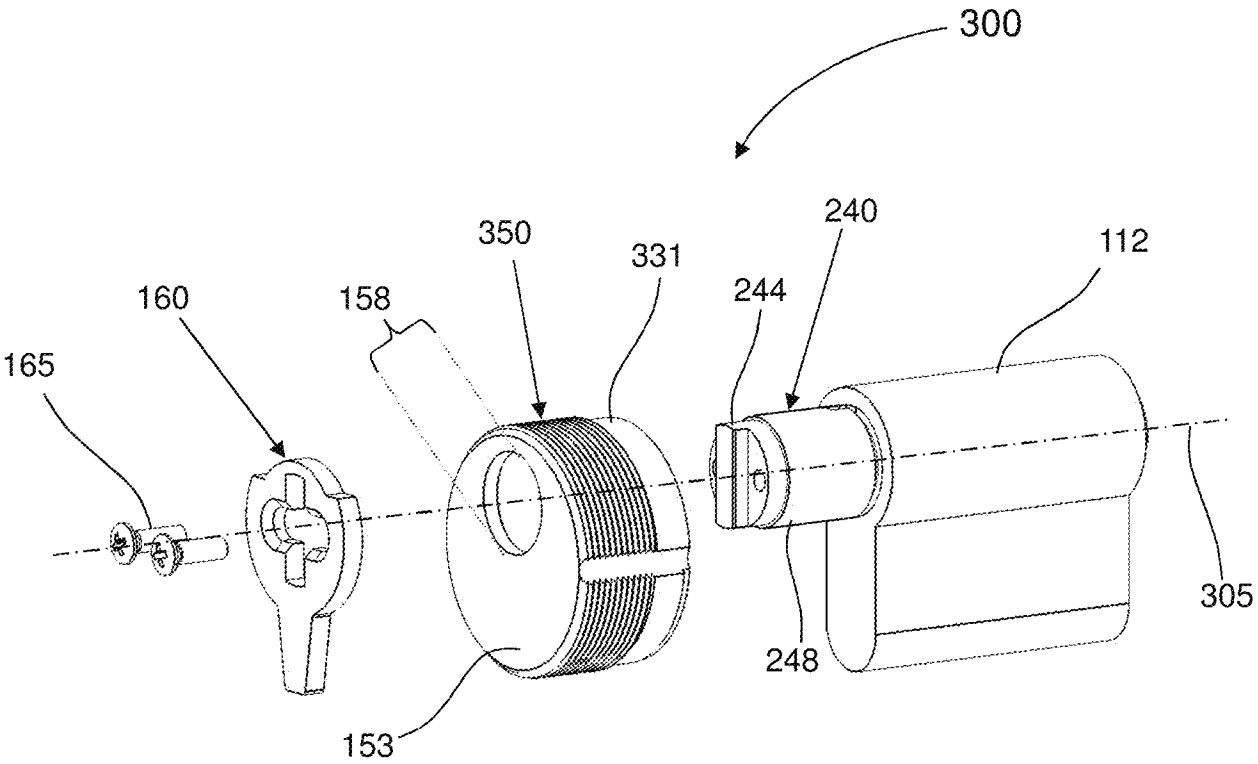
FIG. 18 is an exploded, rear elevated perspective view illustration of cylinder-lock, as shown in FIG. 5*a*.

Similar to one-piece mortise-housing adaptor 135, the one-piece American-mortise-adaptor 350 is typically cylindrical and defines a through cylindrical bore 158 (see FIGS. 16*b* and 18). Through cylindrical bore 158 is configured to receive cylindrical-end-portion 146 of rotation-conveyor 140, or cylindrical-end-portion 246 of rotation-conveyor section 248. Partially through cylindrical bore 352, formed at the European-side-face 333 of American-mortise-adaptor 350, is configured to receive the cylindrical portion 116 (see FIG. 7*a*) of cylinder-housing 112 and cylindrical body 148, of rotation-conveyor 140, or the main body of rotation-conveyor section 248. Through cylindrical bore 158 is formed such that its inner hollow space fully overlaps with the inner hollow space of partially through bore 352, forming a bench 156 (see FIG. 16*a*). Bench 156 of American-mortise-adaptor 350 serves as a stopper to cylindrical-bench 147 of rotation-conveyor 140 or to cylindrical-bench 247 of key-receiving-and-rotation-conveyor 240.

The axis of through cylindrical bore 158 is offset from the central axis of American-lock-housing-member 150, which axis of through cylindrical bore 158 coincides with rotational axis 105 or rotational axis 205 of cylinder-lock 200, or rotational axis 305 of cylinder-lock 300, respectively. The diameter of American-mortise-adaptor 350 allows American-mortise-adaptor 350 to fit in a preconfigured orifice defined in the American type mortise lock housing.

Optionally, cylinder-lock 100 includes a non-rotating body, an operationally rotatable member having a rotational axis and an external surface. The cylinder lock further includes an electronic system for indicating whether the cylinder lock has been rotated.

The electronic system includes a marker 192, securely disposed on or proximal to the external surface of a rotatable member, such as rotation-conveyor 140, at a respective marker location. The electronic system further includes a sensor 190 disposed inside the non-rotating body of the cylinder-lock 100, such as cylinder member 130, proximal to the external surface of the rotatable member, wherein the marker is radially aligned with the sensor.

Typically, the electronic system further includes a processor and indication means, such as a LED light (not shown), that is operationally connected to sensor 190 and to the processor.

A zero state of the lock is when marker 192 is aligned with sensor 190.

When the rotatable member (rotation-conveyor 140) is rotated, the alignment between marker 192 and sensor 190 is broken to thereby turn ON the indication means by the processor.

Preferably, with no limitation, the sensor is made as a reed switch. Optionally, the sensor is made as Hall sensors.

It should be noted that in all embodiments of the present invention, all the components of the electronic system that are integrated into the cylinder lock, are integrated such that none of the components interfere with the operation of the cylinder lock.

It should be further noted that preferably, in all embodiments of the present invention, the integration of components of the electronic system into the cylinder lock, does not alter the form of standard components of the standard cylinder lock.

The invention being thus described in terms of embodiments and examples; it will be obvious that the same may be varied in many ways. Such variations are not to be regarded as a departure from the spirit and scope of the invention, and all such modifications as would be obvious to one skilled in the art are intended to be included within the scope of the claims.

What is claimed is:

1. A cylinder-lock assembly configured to allow affixing accessories that are designed to be operatively coupled with a European locking cylinder, to operate an American type mortise lock mechanism, the cylinder-lock assembly comprises: a) a cylinder-lock-member comprising a cylinder-housing, having an external shape of a European cylinder housing, and a cylindrical lock core having a cylindrical shaft and a key verification mechanism, wherein said cylinder-housing defines a cylindrical through bore configured to receive said cylindrical shaft adapted to rotate there inside said cylinder-housing, wherein a key engagement end of said cylindrical lock core is adapted to receive a fitted key into a first key-receiving-slit formed therein parallel to the rotational axis of said cylindrical shaft, and wherein a lateral slit is formed at the second circular end of said cylindrical shaft; b) an adapting-ring, said adapting-ring defining a first cylindrical through bore on a first side, and a second European-profile shaped through bore on the second side, wherein said first cylindrical through bore and said second European-profile shaped through bore are partially through bores, and wherein said second European-profile shaped through bore is configured to receive said cylinder-housing; c) a cylindrical American-lock-housing-member having the dimensions of a standard American cylindrical lock housing, said American-lock-housing-member defining a through cylindrical bore, wherein said first cylindrical through bore of said adapting-ring is configured to receive said American-lock-housing-member; d) a rotation-conveyor having a first end defining a first rectangular protruding portion, and a second circular end defining a second rectangular protruding portion, wherein said rotation-conveyor is configured to rotate within said through cylindrical bore of said American-lock-housing-member, and wherein said first rectangular protruding portion is configured to be disposed inside said lateral slit to thereby operationally engage said rotation-conveyor with said cylindrical shaft; e) an American-lock cam, with a cam arm and a body having a rectangular opening formed therein, said rectangular opening configured to receive said second rectangular protruding portion of said rotation-conveyor, and said American-lock cam having fastener openings on each side of said rectangular opening, said cam arm is configured to operatively actuate the door lock/unlock mechanism of the American type mortise lock; and f) at least two fasteners configured to secure said American-lock cam to said second circular end of said rotation-conveyor that is disposed inside said through cylindrical bore of said American-lock-housing-member, wherein said cylinder-lock assembly is configured to operatively convey rotational motion of said fitted key, disposed inside said first key-receiving-slit of said cylindrical shaft, to said American-lock cam, to thereby actuate the door lock/unlock mechanism of the American type mortise lock.

2. The cylinder-lock assembly of claim 1, wherein said adapting-ring and said American-lock-housing-member are configured as a single unit (a mortise-housing-adaptor or an American-mortise-adaptor), and wherein said American-lock-housing-member is fused into said first cylindrical through bore of said adapting-ring.

3. The cylinder-lock assembly of claim 1, wherein said cylinder-lock-member and said rotation-conveyor are configured as a single unit, and wherein said first rectangular protruding portion of said rotation-conveyor is fused into said second circular end of said cylindrical shaft and said lateral slit, forming a one-piece key-receiving-and-rotation-conveyor.

4. The cylinder-lock assembly of claim 3, wherein said one-piece key-receiving-and-rotation-conveyor includes a cylindrical shaft section and rotation-conveyor section, wherein a second key-receiving-slit, configured to receive a fitted key, is formed therein parallel to the rotational axis of said key-receiving-and-rotation-conveyor, and wherein said second key-receiving-slit is extended into rotation-conveyor section.

5. The cylinder-lock assembly of claim 1, wherein the non-through sections of said first cylindrical through bore forms at least one inner wall that is used as stoppers for said American-lock-housing-member.

6. The cylinder-lock assembly of claim 1, wherein the non-through section of said second European-profile shaped through bore forms an inner wall that is used as a stopper for said cylinder-lock-member.

7. The cylinder-lock assembly of claim 1, wherein said cylinder-lock assembly further includes a protective plate.

8. The cylinder-lock assembly of claim 1, wherein said cylinder-lock assembly further includes a protective plate and a roseta, said protective plate and said roseta being affixing accessories.

9. The cylinder-lock assembly of claim 1, wherein said lateral slit partially overlaps with said first key-receiving-slit.

10. The cylinder-lock assembly of claim 1, wherein said lateral slit does not overlap with said first key-receiving-slit.

11. The cylinder-lock assembly of claim 10, wherein an additional lateral slit is formed at said second circular end of said cylindrical shaft.

12. The cylinder-lock assembly of claim 1, wherein after said American-lock-housing-member is inserted into said first cylindrical through bore, said American-lock-housing-member is secured in position by attaching means.

13. The cylinder-lock assembly of claim 3, wherein said cylinder-lock assembly further comprises an electronic system for indicating whether said cylinder-lock assembly, said cylindrical shaft or said key-receiving-and-rotation-conveyor have been rotated.

14. The cylinder-lock assembly of claim 13, wherein said electronic system comprises: a) a marker, securely disposed on or proximal to the external surface of a rotatable member at a respective marker location; and b) a sensor disposed inside the a non-rotating body of said cylinder-lock proximal to said external surface of said rotatable member, wherein said marker is radially aligned with said sensor.

15. The cylinder-lock assembly of claim 14, wherein said electronic system further comprising a processor and indication means, wherein said indication means is operationally connected to said sensor and to said processor, and wherein when said rotatable member is rotated, the alignment between said marker and said sensor is broken, to thereby turn ON said indication means by said processor.

16. The cylinder-lock assembly of claim 14, wherein said sensor is made as a reed switch.

17. The cylinder-lock assembly of claim 14, wherein said sensor is made as Hall sensors.

* * * * *